US008740286B2

(12) United States Patent
Aizik et al.

(10) Patent No.: US 8,740,286 B2
(45) Date of Patent: Jun. 3, 2014

(54) REINFORCEMENT SYSTEM FOR A VEHICLE

(75) Inventors: Felix Aizik, D. N. Golan (IL); Zvi Anosh Asaf, Kinnutz Afek (IL); Itzhak Kuchuk-Katalan, Kibbutz Dafna (IL)

(73) Assignee: Plasan Sasa Ltd., M.P. Marom Hagalil (IL)

( * ) Notice: Subject to any disclaimer, the term of this patent is extended or adjusted under 35 U.S.C. 154(b) by 154 days.

(21) Appl. No.: 13/206,197

(22) Filed: Aug. 9, 2011

(65) Prior Publication Data

US 2012/0049570 A1 Mar. 1, 2012

(30) Foreign Application Priority Data

Aug. 9, 2010 (IL) ..... 207490
Aug. 9, 2010 (IL) ..... 207491

(51) Int. Cl.
*F41H 7/02* (2006.01)

(52) U.S. Cl.
USPC ..... 296/187.08; 296/187.07; 296/193.07; 89/36.08

(58) Field of Classification Search
USPC ..... 296/187.08, 204, 193.07, 187.07; 89/36.08
See application file for complete search history.

(56) References Cited

U.S. PATENT DOCUMENTS 4,518,196 A * 5/1985 Forster et al. ..... 296/204
5,533,781 A * 7/1996 Williams ..... 296/204
6,805,401 B2 * 10/2004 Hayashi et al. ..... 296/204
7,114,764 B1 * 10/2006 Barsoum et al. ..... 296/193.07
7,712,823 B2 * 5/2010 Greuter et al. ..... 296/187.07
7,954,419 B2 * 6/2011 Ran et al. ..... 89/36.08
7,992,924 B2 * 8/2011 Boczek et al. ..... 296/187.08
7,997,182 B1 * 8/2011 Cox ..... 89/36.09
8,033,208 B2 * 10/2011 Joynt et al. ..... 89/36.08
8,146,477 B2 * 4/2012 Joynt ..... 89/36.08
8,240,748 B2 * 8/2012 Chapman ..... 296/193.04
8,336,440 B2 * 12/2012 Mills et al. ..... 89/36.08
8,413,567 B2 * 4/2013 Luther et al. ..... 89/36.08
8,413,568 B2 * 4/2013 Kosheleff ..... 89/36.08
8,448,559 B2 * 5/2013 Hunn et al. ..... 89/36.08
8,459,167 B1 * 6/2013 Gonzalez ..... 89/36.02
2002/0145308 A1 * 10/2002 Honlinger ..... 296/193
2011/0138994 A1 * 6/2011 Joynt et al. ..... 89/36.08
2011/0314999 A1 * 12/2011 Luther et al. ..... 89/36.02
2012/0049570 A1 * 3/2012 Aizik ..... 296/187.08
2012/0174767 A1 * 7/2012 Naroditsky et al. ..... 89/36.08
2012/0186428 A1 * 7/2012 Peer et al. ..... 89/36.02
2012/0210861 A1 * 8/2012 Tobie ..... 89/36.04
2013/0082483 A1 * 4/2013 Adams ..... 296/204

* cited by examiner

*Primary Examiner* — Glenn Dayoan
*Assistant Examiner* — Gregory Blankenship
(74) *Attorney, Agent, or Firm* — Dorsey & Whitney LLP

(57) ABSTRACT

A reinforcement system for a vehicle comprising side walls and a floor extending therebetween and meeting with each side wall along an intersection line dividing the side wall into an upper and a lower side wall section. The vehicle further comprises a belly attached to the lower side wall section at a location thereof spaced from the intersection line. The reinforcement system comprises a central reinforcement assembly configured for reducing deformation of the floor due to torque generated along the longitudinal direction of the vehicle. The reinforcement system further comprises a peripheral reinforcement assembly configured for localizing bending of the side wall at the lower side wall portion due to movement of the belly towards the floor.

18 Claims, 25 Drawing Sheets

REINFORCEMENT SYSTEM FOR A VEHICLE

CROSS-REFERENCE TO RELATED APPLICATIONS

This application claims priority to Israel Patent Application No. 207490 filed on 9 Aug. 2010 and Israel Patent Application No. 207491 filed on 9 Aug. 2010, the contents of the foregoing applications are incorporated herein, in their entirety, by this reference.

TECHNICAL FIELD

The subject matter of the present application relates to structural reinforcement systems for vehicles, in particular, blast reinforcement for reinforcing parts of the vehicle's structure during an explosion.

BACKGROUND

It is known that if a vehicle is subjected to sudden external forces, such as those caused when an outer surface of the vehicle is impacted by an explosion, damage to objects and injury to occupants within the vehicle can occur. Thus, in the field of armored vehicles, it is known to provide vehicles with belly armor against explosion/blast taking place under the vehicle (e.g. when the vehicle is positioned on the ground in its standard position, and either located or passing above an explosive device).

In general, most such vehicles comprise a floor, forming the bottom portion of a space in which the occupants are contained within the vehicle. Under the effect of such an explosion/blast, the floor tends to deform in an upward direction. The purpose of belly armor is to reduce, as much as possible, the deformation of the floor under the forces of an explosion/blast.

A common explosive threat used against a vehicle, such as an armored personnel carrier, is a mine planted on a ground surface, above which the vehicle is likely to pass. When the vehicle passes over the mine, the mine detonates, causing extremely high forces and shrapnel to be projected at a belly of the vehicle. The forces applied on the belly can cause at least a part of it which is closest to the source of the explosion to be violently projected in a direction towards a floor of an occupant compartment in the vehicle, for example a passenger compartment containing passengers. Additionally, motion of the belly can cause it to apply a moment to connected side walls of the vehicle, which in turn are cause them to bend. Such bending of the side walls can cause undesired motion and/or damage of the floor and or detachment of the floor of the compartment, to which the side walls are directly or indirectly connected. Such undesired motion and/or damage and/or detachment of the floor of the compartment can cause injury to occupants within the compartment and damage objects therein.

In addition, since most vehicles have a length greater than their width, the moment of inertia is such that deformation along the longitudinal direction (i.e. between the front and the rear of the vehicle) tends to be greater than deformation along the width direction (between a left side and a right side of the vehicle).

SUMMARY

The subject matter of the present application calls for a central reinforcement assembly configured for reinforcing a floor and drive-train tunnel of a vehicle, in order to better withstand blast forces acting on a bottom of the vehicle.

For purpose of convenience, the following terminology will be used:

Longitudinal direction of the vehicle—the direction defined along a longitudinal axis extending between a front and a rear of the vehicle;

Above/below and/or top/bottom—defined with respect to a vertical axis, i.e. an axis perpendicular to a horizontal reference plane, i.e. a plane tangent to all wheels of the vehicle (e.g. ground). For example, a roof of the vehicle is disposed above a floor of the vehicle with respect the vertical axis.

Width direction—direction defined along an axis extending between a left side and a right side of the vehicle, i.e. perpendicular to both longitudinal and vertical axes of the vehicle.

According to a first aspect of the subject matter of the present application, there is provided a reinforcement system for a vehicle comprising:

side walls;

a floor extending therebetween and meeting with each side wall along an intersection line dividing the side wall into an upper and a lower side wall section;

a belly attached to the lower side wall section at a location thereof spaced from the intersection line; and the reinforcement system comprises:

a central reinforcement assembly configured for reducing deformation of the floor due to torque generated along the longitudinal direction of the vehicle; and a peripheral reinforcement assembly configured for localizing bending of the side wall at the lower side wall portion due to movement of the belly towards the floor.

It should be understood that by reinforcing the floor of the vehicle along the longitudinal direction, while at the same time weakening a portion of the side wall to perform localized deformation under load, provides for a system which, on the one hand, reduces the stresses applied to the floor by deformation of the belly and side walls, and on the other hand, provides sufficient structural strength against the remaining stresses by strengthening of the floor.

More specifically, the peripheral reinforcement assembly provides for an effective mechanical dissociation between the lower and upper side wall sections, so that under an explosion beneath the vehicle, the forces of the explosion mitigated to the floor and sidewalls of the vehicle by the belly of the vehicle are considerably reduced. In addition, owing to the central reinforcement assembly, the side walls and floor of the vehicle are configured to better withstand those forces that are mitigated thereto.

As a result of the above, the arrangement can be such that the central reinforcement and the peripheral reinforcement, provide, in combination, a reinforced structure of the vehicle, configured to provide the at least the same ballistic protection as that of a vehicle having a belly armor, but no reinforcing system.

It should be understood that the above disclosed design is configured for protecting occupants of the vehicle from expected blast forces applied to the bottom of the vehicle. One advantage of the above design is that it allows reducing the weight of a belly armor of the vehicle while still being able to withstand the same predetermined Blast. In other words, compared to a vehicle having no structural reinforcement as suggested above and a belly armor of weight W, and configured for withstanding the predetermined blast forces, the present design provides a central reinforcement assembly allowing withstanding the same forces with a belly armor of weight W', which is considerably less than W. Moreover, for a central reinforcement assembly having a weight w, the design is such that W'+w<<W (i.e. even the sum weight of the central reinforcement assembly and the reduced weight belly is still much less than the original weight of the belly armor, while providing the same amount of protection).

The effectiveness of the central reinforcement assembly can be so great, that the use of belly armor can be avoided altogether. In other words, the blast protection provided by the above suggested design is equal to that provided by belly armor (e.g. w<<W).

Thus, structural reinforcement of specific elements of the vehicle compensates for the need of a heavy belly armor, i.e. the belly can be free of any ballistic armor.

Furthermore, it is appreciated that using structural reinforcement as suggested above, is performed completely on an internal portion of the vehicle, i.e. without the addition of elements to the outside of the vehicle (e.g. an add-on belly armor). Thus, when incorporating the reinforcement system, the size, dimensions, shape and aesthetic appearance of the vehicle is not significantly altered (in comparison with a vehicle in which such reinforcement system is not installed).

One of the advantages of the above arrangement, and the elimination of the need for an add-on armor at the bottom of the vehicle, is that it allows for a considerably greater ground clearance for the vehicle, i.e. the distance between the lowermost reference plane tangent to the wheels of the vehicle and the bottom-most point of the body of the vehicle (not including the wheels).

The central reinforcement assembly can comprise at least a first and a second longitudinal beam oriented parallel to each other, each beam extending along one side of the drive-train when the central reinforcement assembly is mounted in the vehicle, and having, in a cross-section taken perpendicular to the longitudinal dimension of the beam, at least one short side and at least one long side, such that the beams face each other with their long sides, the central reinforcement assembly further comprising a load distribution plate extending along the drive-train when the central reinforcement assembly is mounted in the vehicle, and oriented perpendicular to the long sides of the longitudinal beams, one short side of each beam facing the plate and being attached thereto, and one short/long side of each beam being attached to an element of the vehicle, at least when the vehicle is in use, the plate being configured for attachment to the floor.

According to a particular example, the element may be a belly of the vehicle, extending under the floor thereof, so that one short side of each of the longitudinal beam is attached to the load distributing plate while the opposite short side of each of the longitudinal beams is fixedly attached to the belly of the vehicle.

Alternatively, the element can be a drive-train tunnel built around the drive-train, comprising at least two parallel side walls to which the longitudinal beams are configured to be connected, and optionally a top wall, above which the load distribution plate is configured to be disposed. The top wall can be oriented perpendicular to the side walls so as to provide the tunnel with a generally rectangular shape (when viewed in cross-section perpendicular to the longitudinal dimension). Thus, at least in cross-section, the shape of the central reinforcement assembly corresponds to the shape of the drive-train tunnel, and configured so that it can be mounted over the drive-train tunnel.

In particular, the arrangement can be such that the longitudinal beams are fixedly attached, via the long side thereof, to the respective side walls of the drive-train tunnel, and the load distribution plate is fixedly attached to the short side of the longitudinal beams (i.e. the plate is not connected directly to the drive-train tunnel but only to the longitudinal beams).

The orientation of the drive-train tunnel can be such that it extends along the longitudinal direction of the vehicle (i.e. between a front and a rear of the vehicle), such that the longitudinal dimension of the beams corresponds to the longitudinal dimension of the vehicle.

The arrangement can be such that the ratio between the lengths of the short side and long side respectively does not exceed 0.5:1, more particularly does not exceed 0.35:1 and even more particularly, does not exceed 0.25:1. For example, it can be 0.1666:1 (3/18). This ratio between the short side and long side of the cross-section allows the longitudinal beams to withstand great forces applied thereto in an upward direction (e.g. forces which are a result of a blast taking place under the vehicle), in particular, withstand bending deformation along the longitudinal direction.

In addition, the design of the central reinforcement assembly can be such that the load distribution plate has an extension, in a direction perpendicular to the long side of the beams, which is much greater in length than that of the short side of the beam. In other words, the surface area of the load distribution plate is much greater than the surface area of the short side of the longitudinal beams.

With the area of the load distribution plate being substantially greater than that of the short sides of the beams, the plate can function to distribute the energy of the impact of the beams along the corresponding area of the floor. This area can be 0.3 of the area of the floor which is free of any reinforcement elements, more particularly 0.5 of the area of the floor, and even more particularly 0.65 of the area of the floor. For example, it can be 0.75 of the area of the floor which is free of any reinforcement elements.

For purpose of increasing the surface of the load distribution plate, the plate can be comprise a central portion extending along the longitudinal direction, and additional flaps extending from the central portion along the width direction. The flaps provide the plate, on the one hand, with an increased surface, and on the other hand, do not significantly increase the weight of the load distribution plate.

The vehicle can further comprise a vehicle floor, the arrangement being such that the drive-train tunnel is disposed under the vehicle floor. Under this design, the load distribution plate can be disposed between the drive-train tunnel and the vehicle floor. More particularly, the load distribution plate can be attached, on a top side thereof, to a bottom side of the floor, and on a bottom side thereof to the short side of the longitudinal beams.

The longitudinal beams can be made of a material less hard than that of the distribution plate. According to a particular example, the beams can be made of RHA steel while the load distribution plate can be made of HH steel. Due to this, in the event of an explosion under the vehicle, the beams can undergo bending deformation, thereby absorbing some energy of the impact, which bending can result in pressing by the beams on the load distribution plate, the hardness of which will allow it to withstand the impact of the beams thereon thereby absorbing additional impact energy.

In addition, in order to further reduce deformation of the floor along both the longitudinal and the width dimensions, the floor boards can have an extension along the height axis of the vehicle which is considerably greater than that of the load distribution plate. In particular, the ratio between the extensions (plate to floor) can be 0.5:1, more particularly 0.3:1, and even more particularly 0.25:1. For example, the ratio can be 0.15:1.

Furthermore, since increasing the thickness of the floor boards entails an increase in the overall weight of the vehicle, it is desired to make the floor boards of a relatively light material. In general, the greater the thickness of the floor board, the light the material used. However, the material should still be hard enough to allow the floor board to withstand bending. One example of such a material can be Aluminum (for purpose of comparison, should the same thickness floor board were made of steel, it would weight three times more).

According to the above design, the central reinforcement assembly defines a general rectangle shape with one missing side. Under this design, there can be defined an inner zone located between the longitudinal beams (i.e. within the rectangle) and an outer zone located outside the beams (i.e. outside the rectangle). In particular, there can also be defined for each beam, an inner long side and an outer long side, corresponding to the inner and outer zones.

Fixed attachments between the longitudinal beams, load distribution plate and the walls of the drive-train tunnel can be such that the majority of the loads applied to the drive-train tunnel as a result of a blast underneath the vehicle, are transferred to the central reinforcement assembly. The fixed attachment can be an integral attachment, i.e. by welding, or can be a detachable attachment, e.g. by bolts, clamps etc.

In addition, the central reinforcement assembly can comprise support ribs, configured for being in contact both with the load distribution plate and the beams, so as to further reinforce the attachment between the latter and the former. More particularly, the ribs can be disposed on the outer zone, and have a first side thereof engaged with the load distribution plate and a second side thereof engaged with the longitudinal beam. The central reinforcement assembly can comprise a plurality of ribs disposed on the outer zone of each of the beams.

The support ribs can be fixedly attached to both the load distribution plate and to the longitudinal beams, in such a way that facilitates maintaining the orientation of the longitudinal beams with respect to the load distribution plate even under the application of blast forces to the central reinforcement assembly. According to a specific example, the support ribs can be welded to both the load distribution plate and the longitudinal beams.

Furthermore, the ribs can be formed with positioning elements and both the load distribution plate and the longitudinal beams can be formed with corresponding apertures for receiving the elements, thus allowing the exact positioning of the ribs before their welding and before the welding of the beams to the plate. Specifically, the plate and beams can be formed with slots, and the support ribs can be formed extensions corresponding in size and shape to the slots.

In particular, in the case of welding, the following attachments can be provided:

a) For each beam—welding the inner long side thereof to the load distribution plate along the entire intersection line therebetween;
b) For each beam—welding the outer long side thereof to the load distribution plate along the entire intersection line therebetween;
c) For each beam—welding the short side of the beam to the load distribution plate;
d) For each support rib—welding of the rib to the outer long side of each beam and to the bottom surface of the load distribution plate;
e) For each beam—welding the inner long side to the corresponding side of the drive-train tunnel; and According to a specific example, the arrangement can be such that, in central reinforcement assembly/assembly of the vehicle, the central reinforcement assembly can be first fully assembled (i.e. the longitudinal beams are fixedly attached to the load distribution plate and the ribs), and only thereafter mounted (as a single central reinforcement assembly) onto the drive-train tunnel. In other words, attachments (a) to (d) as defined above are performed first, and only thereafter, attachment (e).

With regards to welding (e), the beams can be formed with openings providing, after the central reinforcement assembly has been mounted onto the drive-train tunnel, with access for welding the beams to the walls of the drive-train tunnel. In particular, each of the beams can be formed with through going openings extending between the inner long side and the outer long side thereof, providing such access.

In assembly, as suggested above, the central reinforcement assembly is first assembled, i.e. the beams are positioned at the desired orientation with respect to the load distribution plate and the support ribs are positioned and engaged with the beams and plate using their respective elements. Thereafter, attachments (a) to (d) take place so as to form a single central reinforcement assembly.

Once ready, the entire central reinforcement assembly is mounted onto the drive-train tunnel and fixedly attached thereto (step (e)). Once attached, the floor boards can be assembled to the vehicle, and be attached to a top surface of the load distribution plate.

It should be noted that according to a specific design, the attachment of the load distribution plate to the floor boards can be detachable, allowing the removal of any single desired floor board so as to provide access to automotive components disposed underneath the floor. In particular, since most vehicles are provided at least with a belly deflector, access to the automotive components from within the vehicle is of great advantage. Specifically, the floor boards and the load distribution plate can be formed with corresponding holes so that the attachment can be performed by bolts.

It should also be noted that in the above design, due to the specific orientation of the longitudinal beams (short side facing up), the beams are adapted for reducing the amount of longitudinal bending of the floor of the vehicle under the application of blast forces to the bottom of the vehicle. It is clear that in case of an explosion under the vehicle (i.e. between the ground and the belly of the vehicle), since most vehicles have a length exceeding their width, the moment of inertia of the vehicle facilitates greater longitudinal bending than bending across the width thereof. The orientation of the beams in the central reinforcement assembly, having a height dimension greater than their width dimension (long side and short side respectively), provides for a considerable reduction of this bending effect.

The reinforcing elements of the peripheral reinforcement assembly can be positioned such that at least a majority of each of the reinforcement elements extends along the upper side wall.

The reinforcement elements and a part of the side wall adjacent thereto can have a combined thickness T1, whilst at least a part of the lower side wall portion has a smaller thickness T2.

The reinforcement elements can be connected to the floor and an adjacent portion of the upper side wall.

The peripheral reinforcement assembly can comprises additional reinforcement elements disposed at a part of the side walls which is attached to the belly, the additional reinforcement elements and a part of the side wall adjacent thereto having a combined thickness T3, whilst at least a part of the lower side wall portion disposed above the part of the side walls which is attached to the belly and below the intersection line has a smaller thickness T2.

According to another aspect of the subject matter of the present application, there is provided a method of manufacturing a vehicle comprising side walls, a floor extending therebetween and meeting with each side wall along an intersection line dividing the side wall into an upper and a lower side wall section, and a belly attached to the lower side wall section at a location thereof spaced from the intersection line, the method comprising manufacturing a part of the side walls adjacent the intersection line to have a thickness T1 greater than at least part of the lower side walls to localize at the lower side wall portion bending of the side wall caused by movement of the belly towards the floor.

The manufacturing of the part can include adding reinforcement elements thereto.

The adding of the reinforcement elements can include positioning the reinforcement elements such that at least a majority of each element extends along the upper side wall.

The manufacturing of the part can include connecting the reinforcement elements to the floor and an adjacent portion of the upper side wall.

The adding can including adding additional reinforcement elements at a part of the side walls which is attached to the belly, the additional reinforcement elements and a part of the side wall adjacent thereto have a combined thickness T3, whilst at least a part of the lower side wall portion disposed above the part of the side walls which is attached to the belly and below the intersection line has a smaller thickness T2.

According to yet a further aspect of the subject matter of the present application, there is provided a reinforcement element for connection to a side wall and floor of a vehicle and being configured to reduce bending motion of the side wall at a portion thereof adjacent the floor.

The reinforcement element can comprise a triangular shaped section configured for engaging the floor and sidewall.

The peripheral reinforcement assembly can comprise any of the features described above in connection with the other aspects.

In accordance with any of the aspects above:

- The peripheral reinforcement assembly can include a first type of reinforcement element configured for engaging the floor and an adjacent portion of a side wall.
- The peripheral reinforcement assembly can include a second type of reinforcement element configured for engaging two adjacent walls of a vehicle.
- The peripheral reinforcement assembly can include a third type of reinforcement element configured for engaging a belly and an adjacent portion of a side wall of a vehicle.
- The side walls can be configured to be more rigid at a portion thereof at the height of the floor, than at a portion of the sidewall therebelow.
- The side walls can be configured to be more flexible at a portion thereof at the height below the floor, than at a portion of the sidewall thereabove.

According to a further aspect of the subject matter of the present application, there is provided a construction configured for the reinforcement of a floor of a vehicle having a drive-train; the construction comprising at least a first and a second longitudinal beam oriented parallel to each other, each beam extending along one side of the drive-train when the construction is mounted in the vehicle, and having, in a cross-section taken perpendicular to the longitudinal dimension of the beam, at least one short side and at least one long side, such that the beams face each other with their long sides, the construction further comprising a load distribution plate extending along the drive-train when the construction is mounted in the vehicle, and oriented perpendicular to the long sides of the longitudinal beams, one short side of each beam facing the plate and being attached thereto, and one long side of each beam being attached to an element of the vehicle associated with the drive-train, at least when the vehicle is in use, the plate being configured for attachment to the floor.

According to still another aspect of the subject matter of the present application there is provided a system for a vehicle comprising side walls, a floor extending therebetween and meeting with each side wall along an intersection line dividing the side wall into an upper and a lower side wall section, and a belly attached to the lower side wall section at a location thereof spaced from the intersection line, the system comprising reinforcement elements configured to localize at the lower side wall portion bending of the side wall caused by movement of the belly towards the floor.

BRIEF DESCRIPTION OF THE DRAWINGS

In order to understand the invention and to see how it can be carried out in practice, embodiments will now be described, by way of non-limiting example only, with reference to the accompanying drawings, in which.

DETAILED DESCRIPTION OF EMBODIMENTS

Figure 1A:
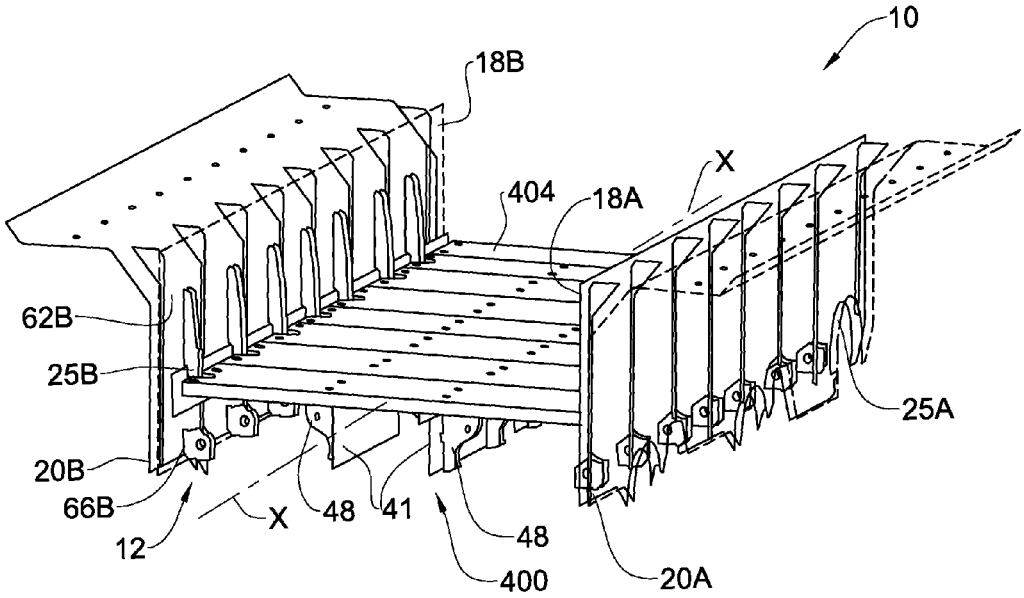
FIG. 1A is schematic perspective view of a portion of a vehicle comprising a system in accordance with one example of the subject matter of the present application.
Figure 1B:
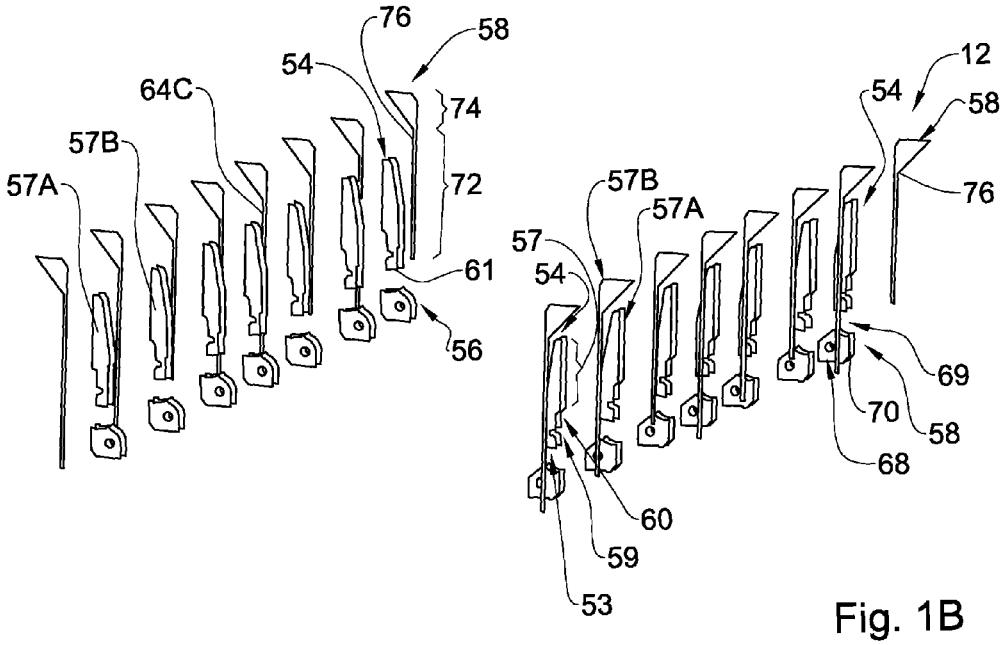
FIG. 1B is a schematic exploded perspective view of elements of the system in FIG. 1A.
Figure 1C:
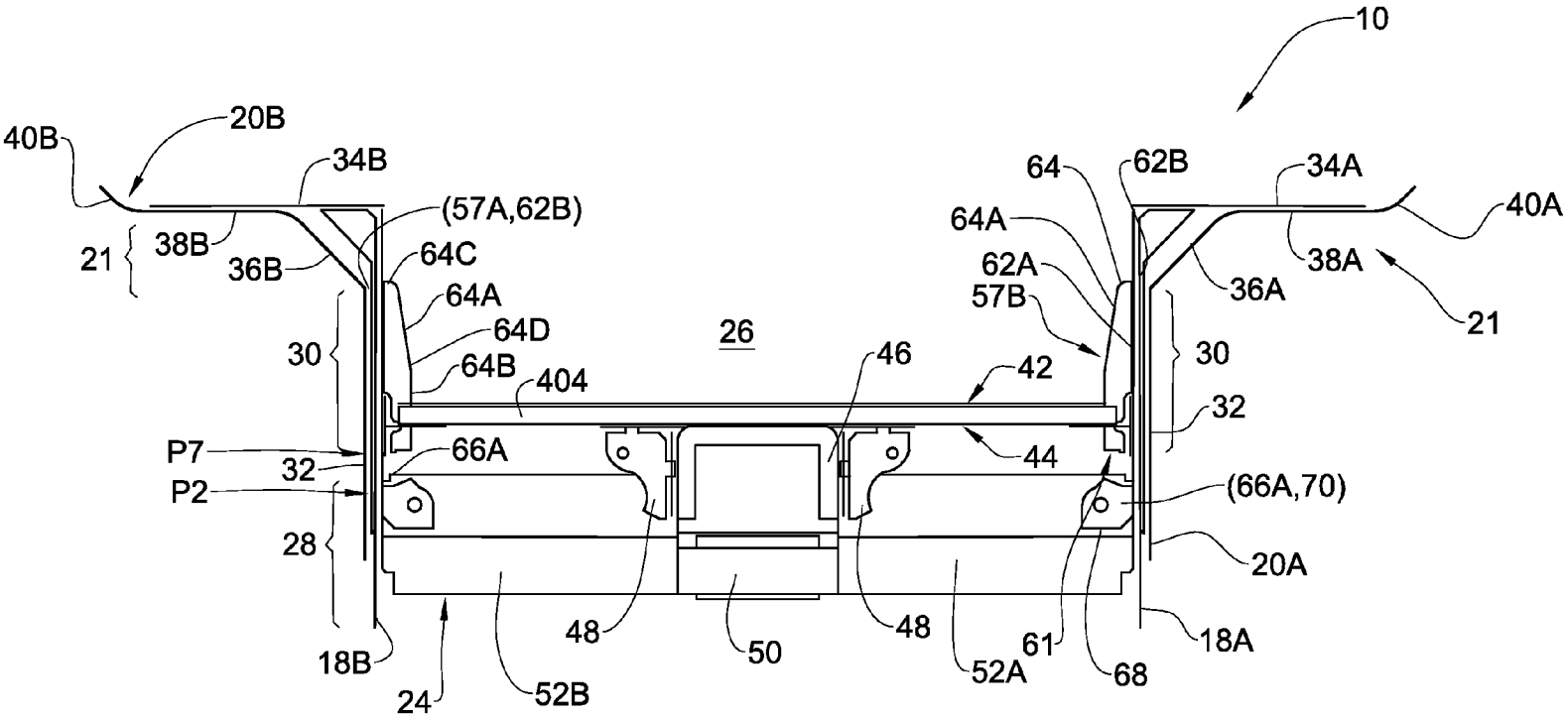
FIG. 1C is a schematic front view of the portion of the vehicle and system in FIG. 1A.
Figure 1D:
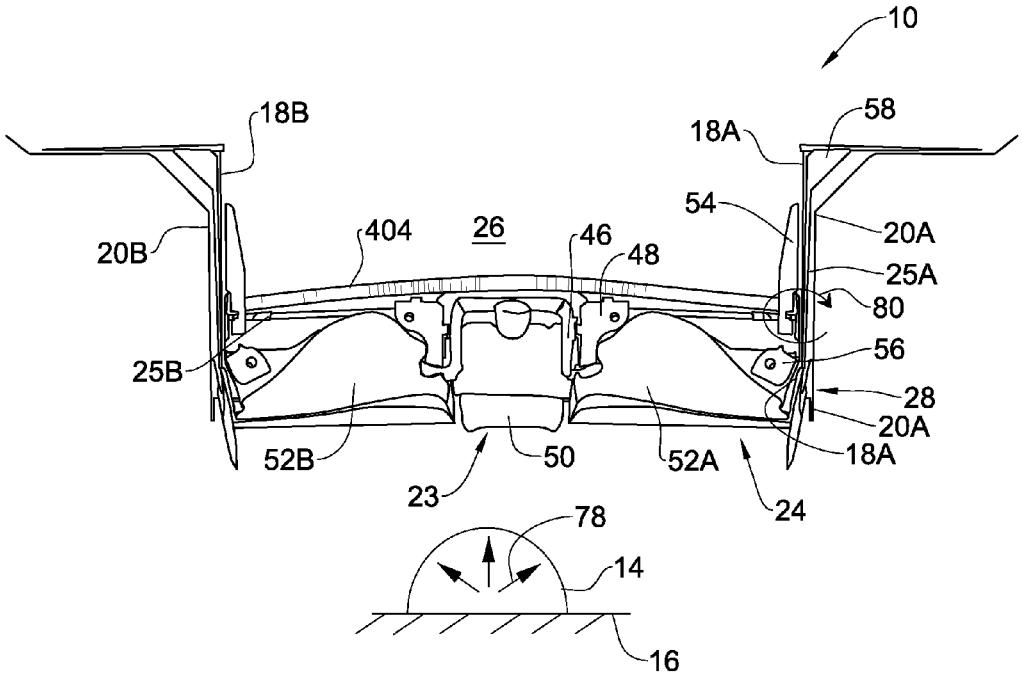
FIG. 1D is a schematic front view of the portion of the vehicle in FIGS. 1A and 1C, during an explosive event.

Referring now to the drawings wherein like reference characters designate like or corresponding parts throughout several views, with reference to FIGS. 1A to 1C, there is illustrated a portion of a first example vehicle generally designated by the numeral 10, which in this example as an armored personnel carrier, and a reinforcement system, disposed within the vehicle 10 for providing protection against an explosive threat, schematically shown as an explosion in FIG. 1D and identified by numeral 14. The explosive threat 14 originating from a portion of the ground 16 disposed underneath the vehicle 10. The reinforcement system comprises a peripheral reinforcement assembly generally designated as 12, and a central reinforcement assembly, generally designated as 400.

The peripheral reinforcement assembly 12 will be discussed mainly with respect to FIGS. 1A to 4, and the central reinforcement assembly 400 will be discussed mainly with respect to FIGS. 5A to 7C.

The vehicle 10 comprises inner side walls (18A,18B), outer side walls (20A,20B), a floor 403 with floorboards 404, a vehicle component central reinforcement assembly 400, a belly generally designated as 24, and side beams (25A,25B) have a T-shaped cross section and connecting the floor 403 to the inner side walls (18A,18B).

An occupant compartment generally designated as 26, is defined within the inner side walls (18A,18B), roof (not shown), floor 403, and front and back walls (not shown).

Drawing attention to FIG. 1C, the side walls (18A,18B, 20A,20B) each have lower and upper sections (28, 30), an intermediate section 32 extending therebetween. In this example the side walls also comprise transverse sections, generally designated as 21, extending in a direction away from the occupant compartment 26.

The boundaries of the lower and upper sections (28, 30), and intermediate section 32, will be further detailed hereinbelow.

The transverse section 21 of the inner side walls (18A,18B) comprises a horizontal section (34A, 34B).

The transverse sections 21 of the outer side walls (20A, 20B) each comprise a first upwardly slanted section (36A, 36B), a horizontal section (34A, 34B), and a second upwardly slanted section (40A, 40B) extending from the adjacent horizontal section (34A, 34B).

The floor 403 extends between the upper sections 30 of the side walls. The floor 403 comprises a lower surface 42 and an upper surface 44.

Referring now to FIGS. 1A and 1C, the central reinforcement assembly 400 comprises beams 420 extending parallel with a longitudinal axis X-X of the vehicle, transverse ribs 48 extending perpendicular to axis X-X and connecting the beams 420 to the lower surface 44 of the floor 403, and at least one cover plate 50 (FIG. 1D). The central reinforcement assembly will be discussed in detail with references to FIGS. 5A to 7C.

The belly 24 comprises a first longitudinal section 52A and a second longitudinal section 52A, each of which extending between the side walls (18A,18B) and the central reinforcement assembly 400.

Referring now to FIG. 1B, the peripheral reinforcement assembly 12 comprises a first plurality of reinforcement elements 54, a second plurality of reinforcement elements 56 and a third plurality of reinforcement elements 58.

The first plurality of reinforcement elements 54 is connected to a surface (62A,62B) of the upper section 30 of one of the sidewalls (18A,18B) which is adjacent to the floor 403 and to the floor 403.

Each of the first plurality of reinforcement elements 54 has a planar shape and comprises an upper portion 57, a lower portion 59, a central portion 60 extending between the upper and lower portions (57,59), and a lower end 61.

The upper portion 57 has an elongated shape and comprises a first side edge 57A having a shape corresponding to an adjacent surface (62A,62B; FIG. 1C) of a wall (18A,18B) to which it engages, and a second side 57B distal from the first side edge 57A.

In the present example, the first side edge 57A is straight.

As best seen in FIG. 1C, the second side edge 57B comprises a slanted portion 64A and a vertical portion 64B.

The slanted portion 64A has an uppermost edge 64C and a lowermost edge 64D. The uppermost edge 64C being a closer horizontal distance to the adjacent surface (62A,62B) than the lowermost edge 64D.

The lower portion 59 extends to a height below the floor 403 and is disposed adjacent a part of the upper section 30 of one of the sidewalls (18A,18B) adjacent the floor 403.

The central portion 60 is secured to the floor 403 and an adjacent side beam (25A,25B).

The second plurality of reinforcement elements 56 are each connected to an adjacent surface (66A,66B) of the lower section 28 of one of the sidewalls (18A,18B) and to an adjacent longitudinal section (52A,52B) of the belly 24.

Referring also to FIG. 1B, each of the second plurality of reinforcement elements 56 has a planar shape and comprises a bottom edge 68 extending along and engaging a portion of the belly 24, an upper edge 69, and a side edge 70 extending between the bottom edge 68 and upper edge 69 (FIG. 1B) and engaging the adjacent surface (66A,66B) of the lower section 28 of the side walls one of the sidewalls (18A,18B).

The third plurality of reinforcement elements 58 are each disposed between and connected to one of the inner side walls and an adjacent outer side wall (18A,18B,20A,20B).

Each of the third plurality of reinforcement elements 58 comprise an elongated portion 72 and a substantially triangular portion 74 extending from a top end 76 of the elongated portion 72.

The intersection of the upper section 30 and the intermediate section 32 of the side walls (18A,18B) corresponds, in this example to point P1, of the lowermost end 61 of the first plurality of reinforcement elements 54. This is because at the height of the side wall at which point P1 is disposed, there is a significant change in the thickness of the side wall. That is to say that the side wall is significantly thicker above point P1, due, in this example, to the presence of the first and third plurality of reinforcement elements (54, 58).

The intersection of the lower section 28 and the intermediate section 32 of the side walls (18A,18B) corresponds to the height of the upper edge 69 of the second plurality of reinforcement elements 56. Similarly, this intersection, denoted by point P2, is at a height of the side wall where there is a significant change in the thickness thereof. That is to say that the side wall is significantly thicker below point P2, due, in this example, to the presence of the second plurality of reinforcement elements (56).

The intermediate section 32 is therefore constituted by a section of the side wall in between other sections which are connected to reinforcement elements. It will be understood that due to the comparative thinness of the intermediate section 32, with respect the adjacent lower and upper sections (28,30), it is therefore relatively weaker than these sections.

Figure 1E:
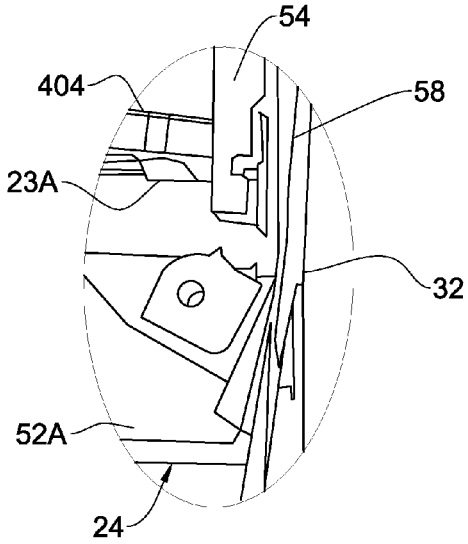
FIG. 1E is a schematic front view of a magnified portion of the vehicle and system in FIG. 1D.

Referring now to FIG. 1E, when an explosion 14 causes upwardly directed forces 78 to impact the belly 24, the first longitudinal section 52A are propelled upwardly, pulling the connected lower sections 28 of the adjacent sidewalls (18A, 20A) inwardly (i.e. towards the direction of the enclosure of the vehicle). As a result of these pulling forces, a clockwise moment 80 about the side walls (18A,20A) is created at a connection of the floor 403 and the side walls (18A,20A). As a result of the presence of the plurality of first and third reinforcement elements (54,58), the upper section (30) is strengthened and significantly resists bending as a result of moment 80. Thus the floor 403 experiences less movement from motion of the side walls than would be the case without reinforcement elements (54,58). Nonetheless, the forces on the side walls (18A,20A) result in bending of a less reinforced section thereof, namely the intermediate section 32 which is free of reinforcement elements and is disposed between the two reinforced lower and upper sections (28,30). Thus the bending occurs at the comparatively weaker intermediate section 32.

It will be understood that even if the second reinforcement elements (56) were not present in the lower section 28, bending would occur at a point on the side wall below a section of the sidewalls comprising reinforcement elements (in this case the upper section 30). The reinforcement elements (56) at the lower section (28) thus cause the position of the bending to be localized at a predetermined and desired position than would be the case in the absence thereof.

It will be noted that a small amount of bending of the floor 403 is illustrated, which is a result of upward motion of the central reinforcement assembly 400 and belly 24, and not forces applied on the floor 403 from the side walls. Reduction of upward motion of the central reinforcement assembly 400 and belly 24 can be facilitated by systems and designs other than those subject the present application.

Figure 2A:
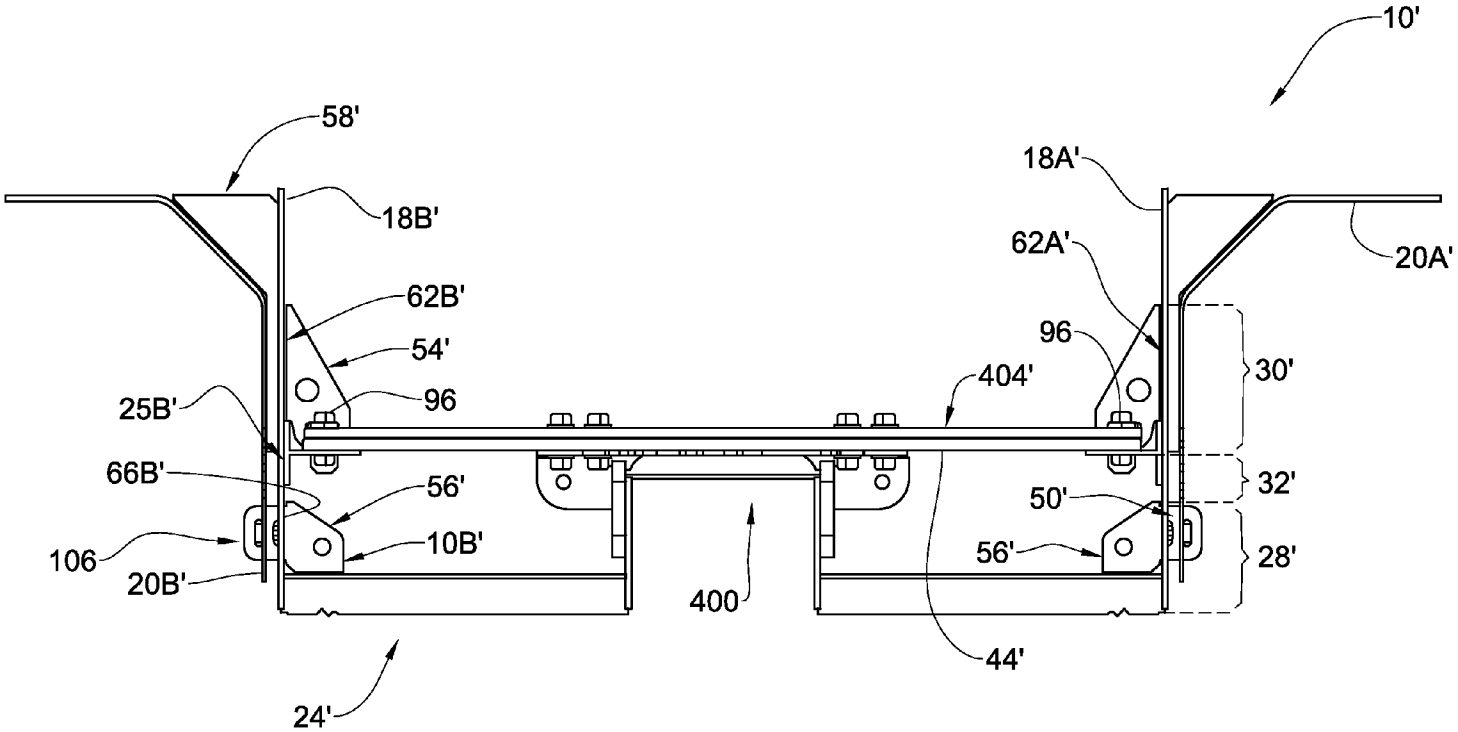
FIG. 2A is a schematic front view of a portion of a vehicle including another example of a system in accordance with the subject matter of the present application.
Figure 2B:
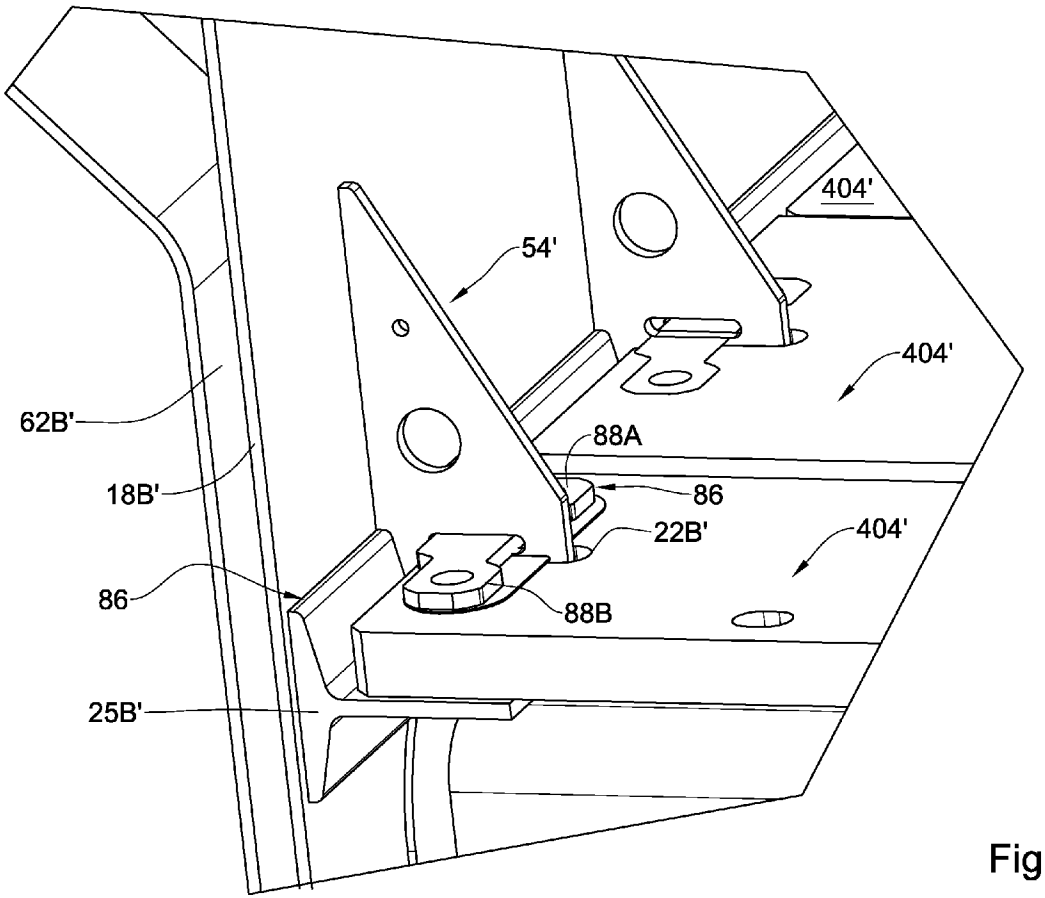
FIG. 2B is schematic perspective view of a portion of the vehicle and system in FIG. 2A.
Figure 2C:
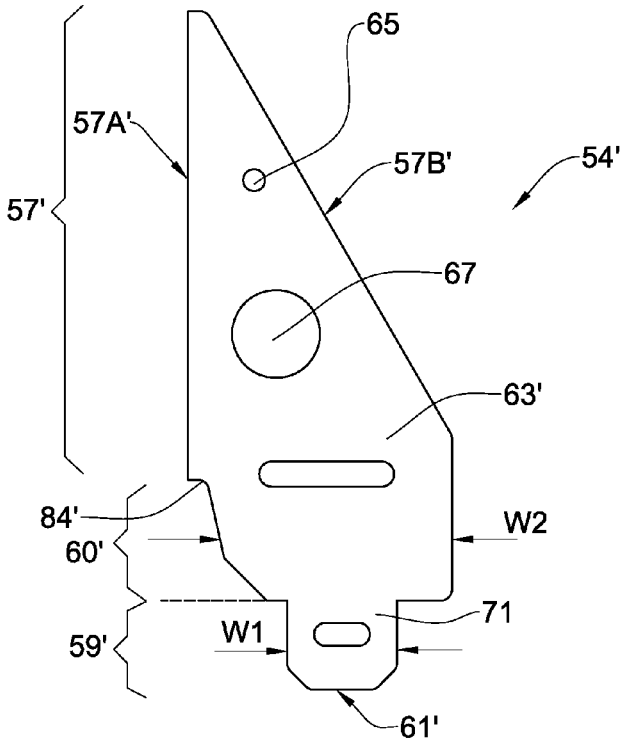
FIG. 2C is schematic front view of an element of the system in FIGS. 2A and 2B.
Figure 2D:
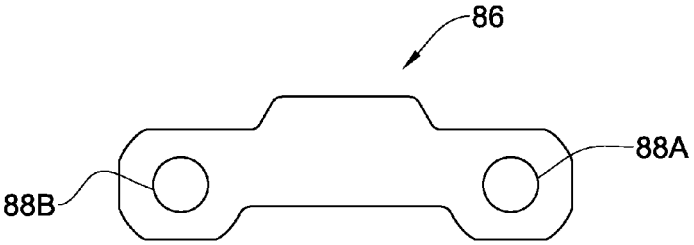
FIG. 2D is schematic top view of an element of the system in FIGS. 2A to 2C.
Figure 2E:
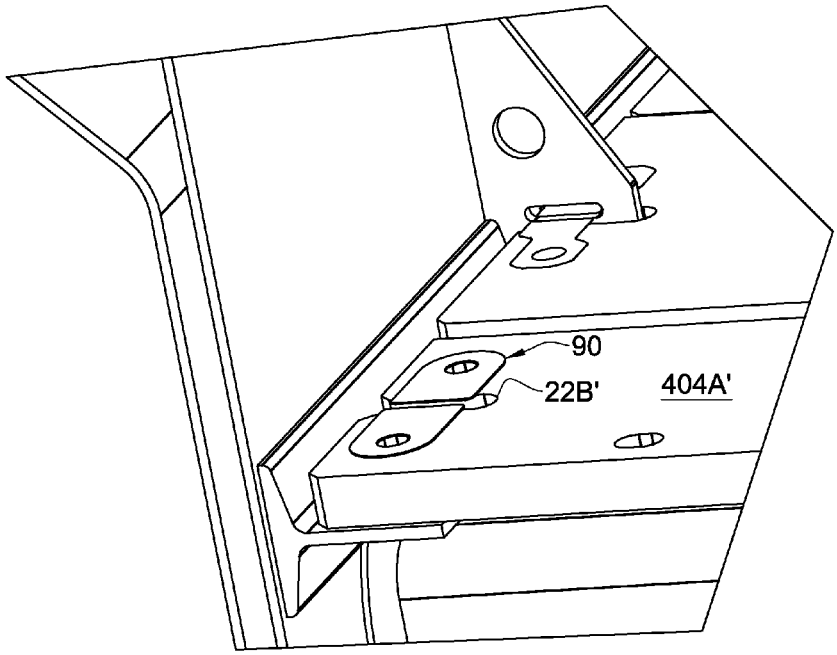
FIG. 2E is schematic perspective view of a portion of the vehicle and system in FIGS. 2A to 2C.
Figure 2F:
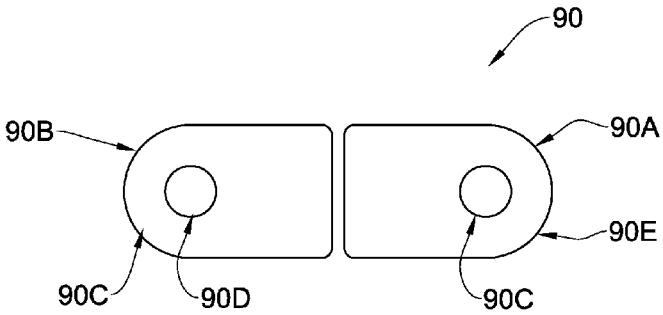
FIG. 2F is schematic top view of an element of the system in FIGS. 2A to 2E.
Figure 2G:
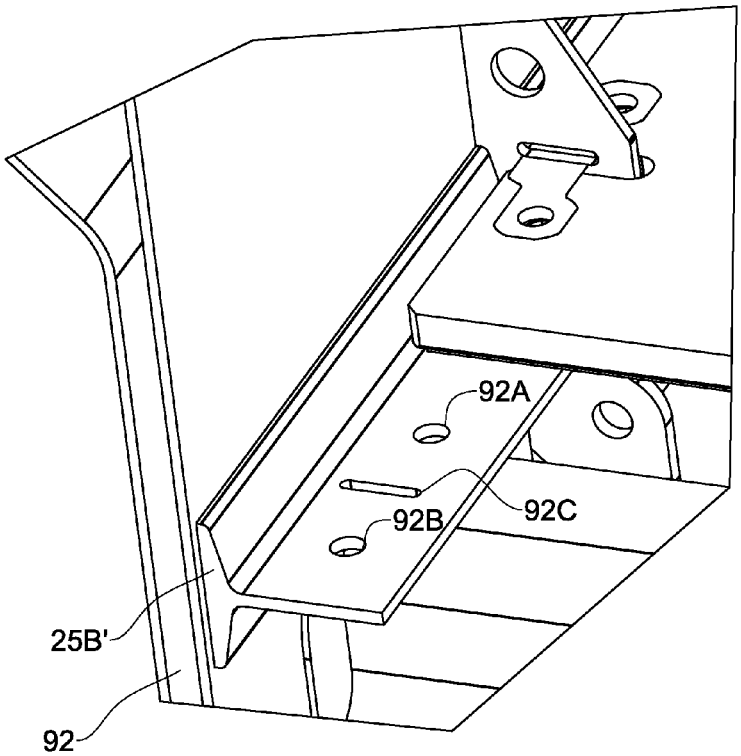
FIG. 2G is schematic perspective view of a portion of the vehicle and system in FIGS. 2A to 2F.
Figure 2H:
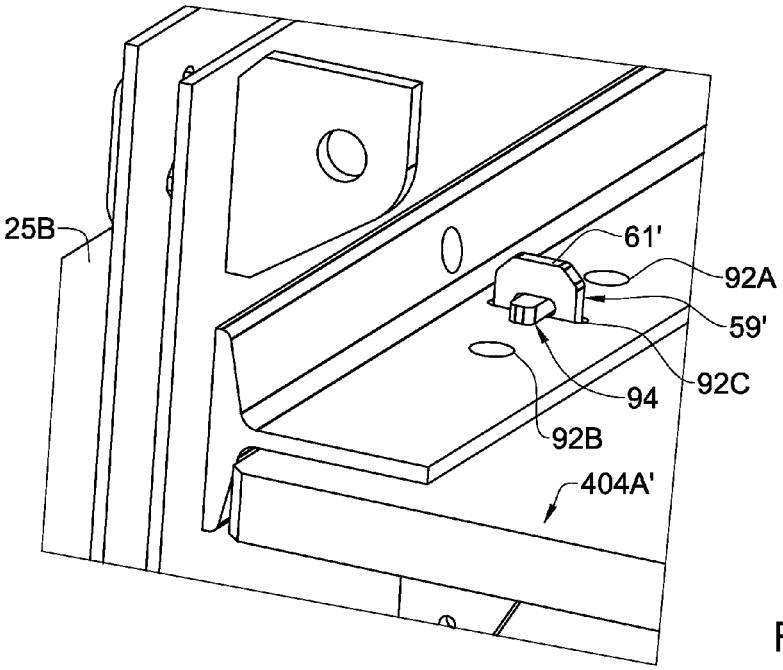
FIG. 2H is schematic perspective view from below of a portion of the vehicle and system in FIGS. 2A to 2G.
Figure 2I:
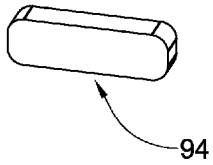
FIG. 2I is schematic top view of an element of the system in FIGS. 2A to 2H.
Figure 2J:
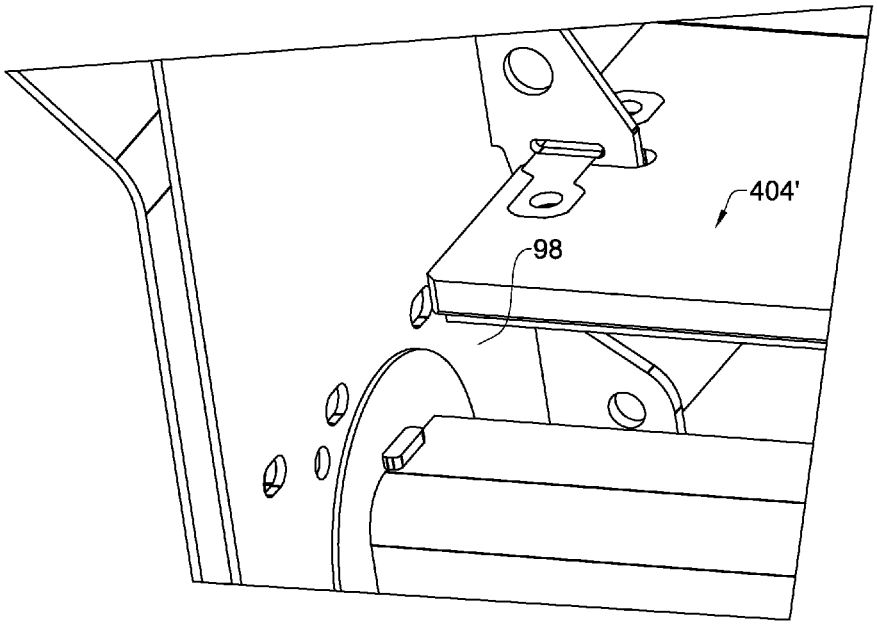
FIG. 2J is schematic perspective view of a portion of the vehicle and system in FIGS. 2A to 2I.
Figure 2K:
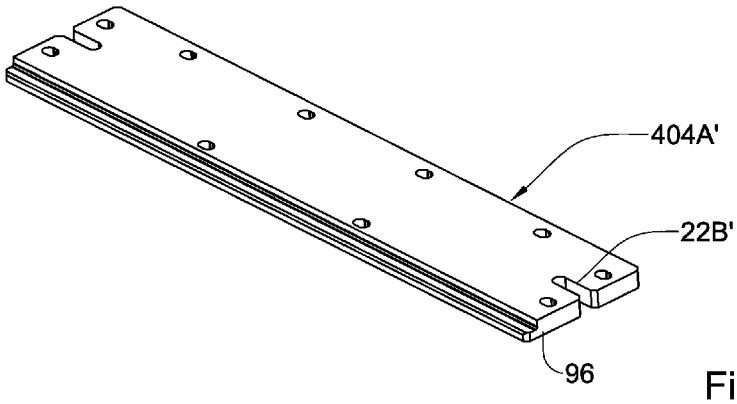
FIG. 2K is schematic perspective view of an element of the vehicle in FIGS. 2A to 2J.
Figure 2L:
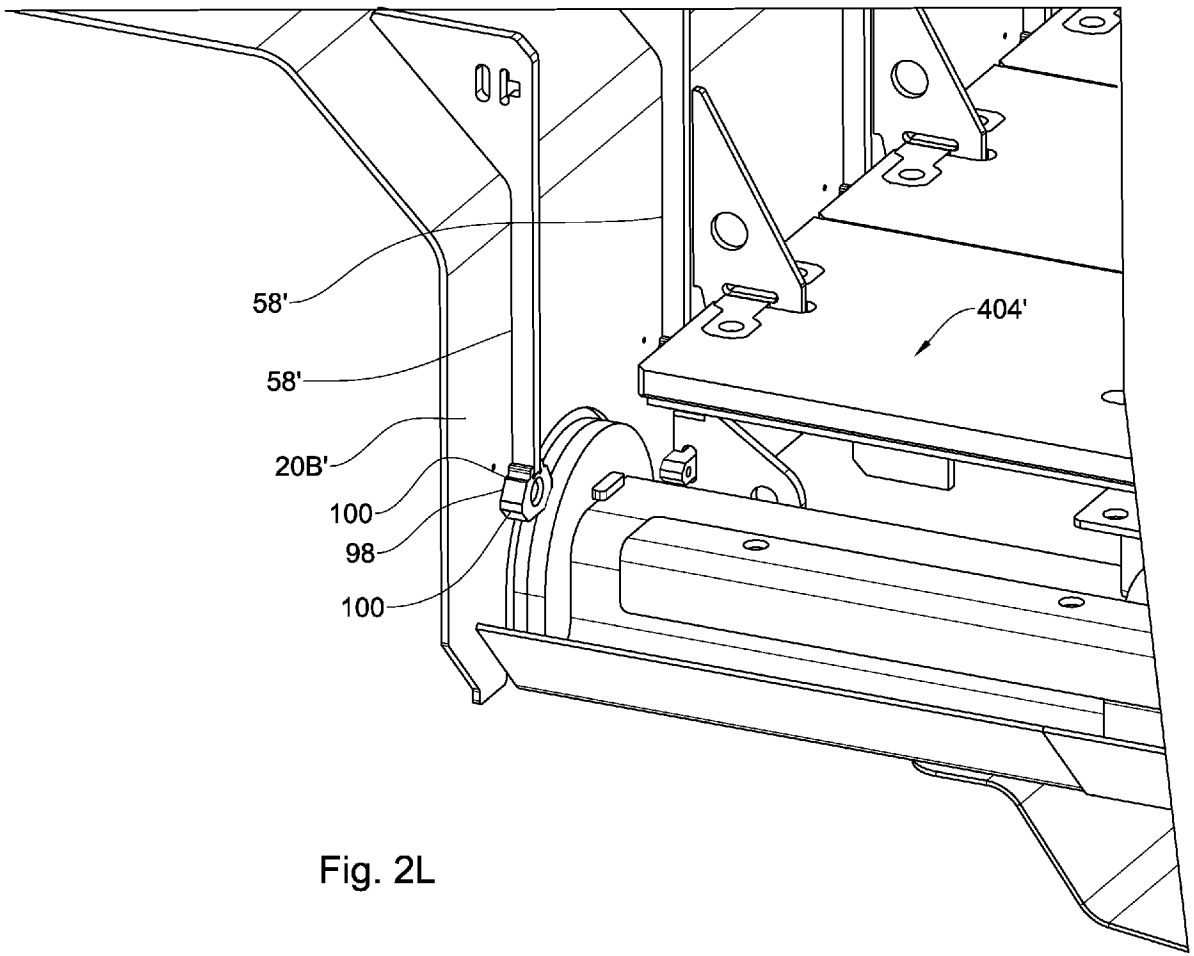
FIG. 2L is schematic perspective view of a portion of the vehicle and system in FIGS. 2A to 2K.
Figure 2M:
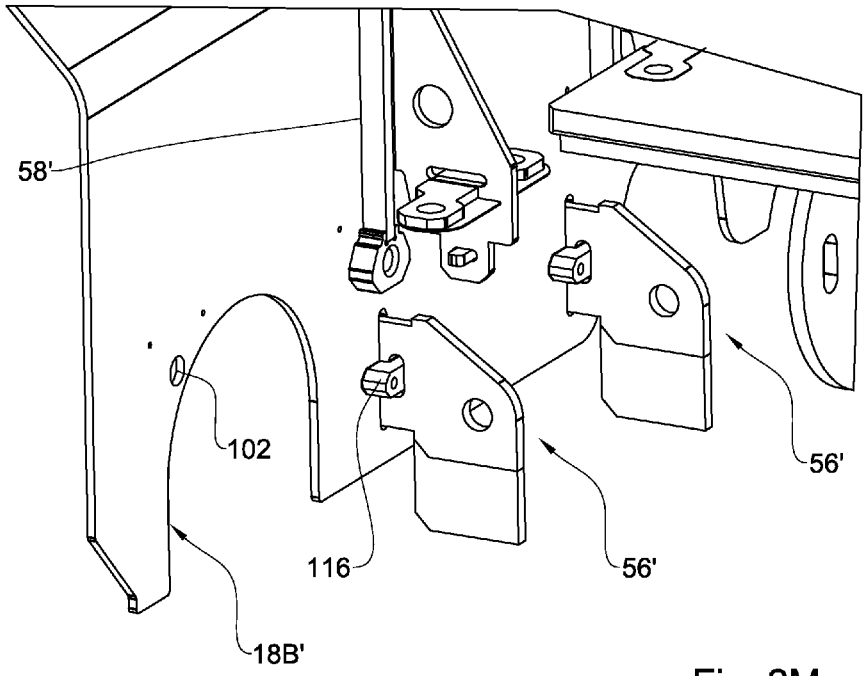
FIG. 2M is schematic perspective view of a portion of the vehicle and system in FIGS. 2A to 2L.
Figure 2N:
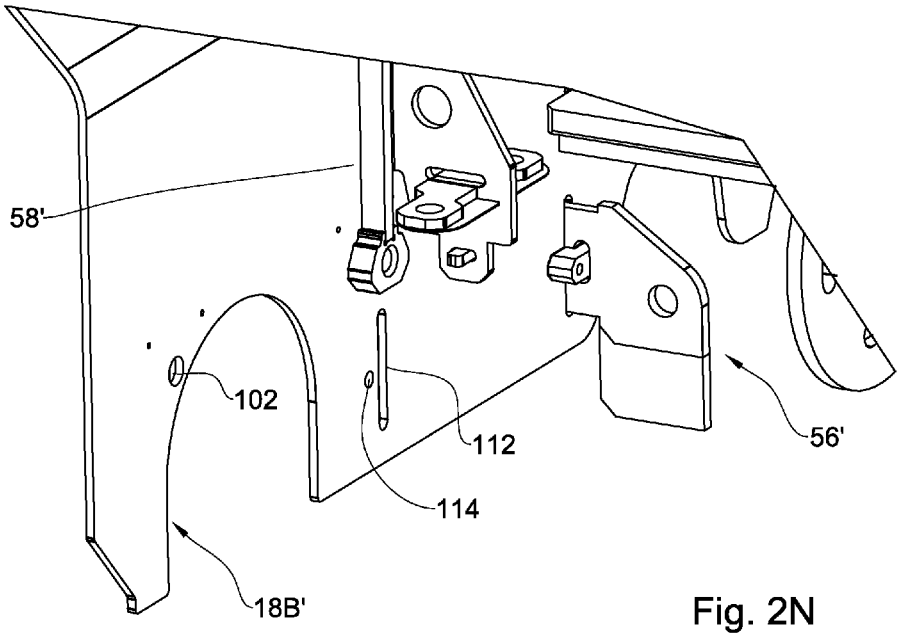
FIG. 2N is schematic perspective view of a portion of the vehicle and system in FIGS. 2A to 2M.
Figure 2O:
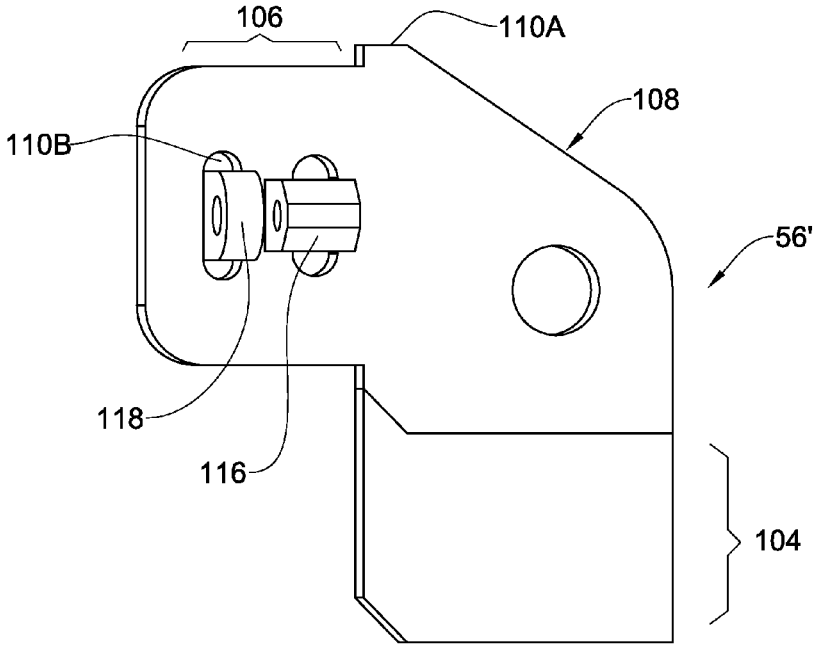
FIG. 2O is schematic perspective front view of elements of the system in FIGS. 2A to 2N.
Figure 2P:
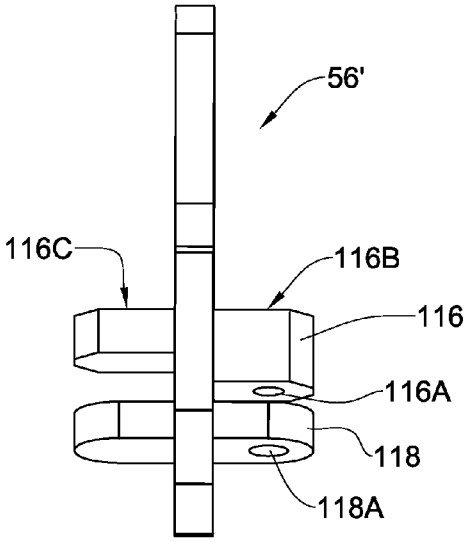
FIG. 2P is schematic perspective top view of the elements in FIG. 2I.
Figure 2Q:
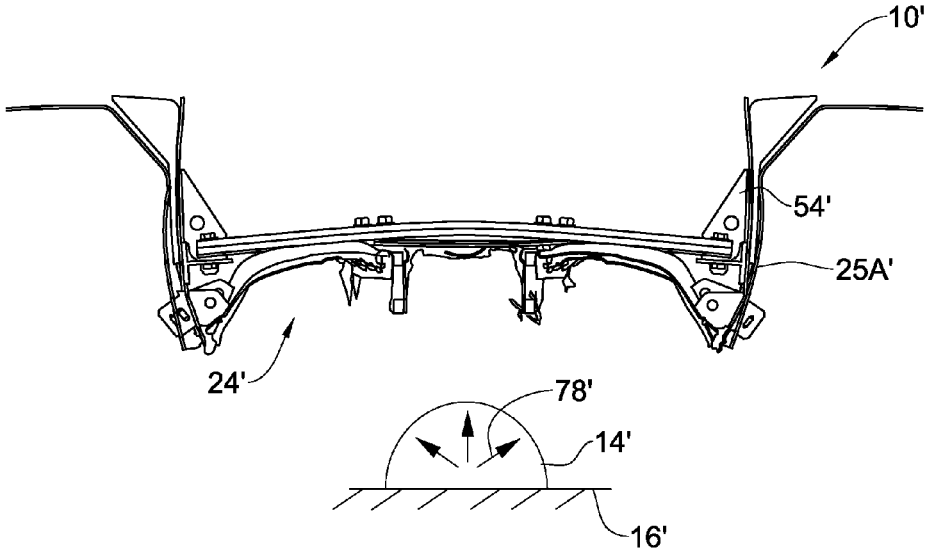
FIG. 2Q is a schematic front view of the portion of the vehicle in FIGS. 2A to 2P, during an explosive event.
Figure 2R:
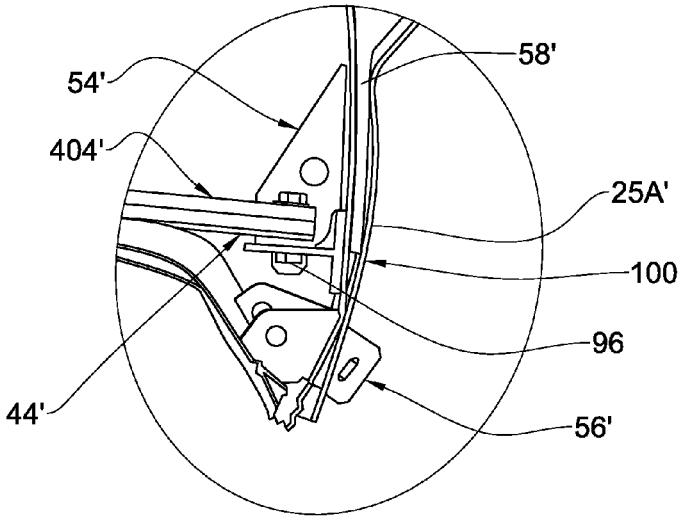
FIG. 2R is a schematic front view of a magnified portion of the vehicle and system in FIG. 2Q.

An alternative system generally designated as 12' is shown in FIGS. 2A to 2R. With reference to FIG. 2A there is illustrated a portion of a second example vehicle generally designated by the numeral 10', which has a similar central reinforcement assembly to the vehicle 10 in FIG. 1. Consequently, elements which resemble those in FIG. 1, or having the same numeral and suffixed with an apostrophe thereto, are to be considered identical to the elements described in connection with the previous example in FIG. 1, except where differences or further details are provided hereinbelow.

The peripheral reinforcement assembly 12' comprises a first plurality of reinforcement elements 54' connected to an adjacent surface (62A',62B') of the upper section 30' of one of the sidewalls (18A',18B') and the floor 403', a second plurality of reinforcement elements 56' connected to an adjacent surface (66A',66B') of the lower section 28 of an adjacent inner and outer sidewall (18A',18B',20A',20B') and the belly 24, and a third plurality of reinforcement elements 58' connected to one of the inner side walls and an adjacent outer side wall (18A',18B',20A',20B').

Referring to FIGS. 2B to 2F, the first plurality of reinforcement elements 54' is connected to the adjacent surface 62B' of the inner side wall 18B', and is secured to one of the floor boards 404 and a side beam 25B'.

As seen best in FIG. 2C, the reinforcement element 54' has a planar shape and comprises an upper portion 57', a lower portion 59', and a central portion 60' extending between the upper and lower portions (56',58'), and a lower end 61'.

The upper portion 57' has an elongated shape and comprises a first side 57A' having a shape corresponding to the adjacent surface 62B' of the wall 18B', and a second side 57B'. The upper portion 57' is of a generally triangular shape and further comprises a first aperture 65' and a second aperture 67 formed therein.

As can be seen from FIGS. 1C and 2A, the upper portion of the reinforcement element 54' has a slightly different shape to that of the reinforcement element 54. It will be understood that the exact height and width dimensions, as well as the shape can vary in accordance with applicable load calculations and the type of vehicle in which the system is to be incorporated.

The lower portion 59' is formed with a slot 71 and notably has a smaller width W1 than a width W2 of the adjacent central portion 60'.

The central portion 60' is also formed with a horizontal slot 63' and an inner edge 84 shaped for mounting on a corresponding upper edge 86 of the side beam 25B' (FIG. 2B).

With particular reference to FIGS. 2B and 2D the element 54' is shown engaging and secured to the side wall 18B' and mounted on the side beam 25B', as well as being inserted in a recess 22B' of floor board 22A'. The element 54' is secured to the floor board 404 via an insert 86. The insert 86 is formed with bores 88A and 88B at opposing sides thereof.

Referring also to FIGS. 2C, 2E and 2F, the insert 86 rests on a pair of spacer members (90A,90B). The spacer members (90A,90B) each are formed with an aperture (90C, 90D) at a curved end (90E, 90F) thereof.

With reference to FIG. 2G, the side beam 25B' can be seen to comprise a horizontally extending portion thereof 92, formed with vertically oriented apertures 92A, 92B and a slot 92C.

The slot 92C is larger than the width W1 of the reinforcing element 54' but smaller than the width W2 thereof, to allow the reinforcement element 54' to be mounted on the side beam 25B'.

Referring to FIG. 2H, the bottom portion 59' of the reinforcement element 54' is inserted through slot 92C and secured to the horizontal portion 92 the side beam 25B', by a pin 94.

Notably, as seen in FIG. 2I, pin 94 is free of apertures has a regular elongated shaped.

Reverting to FIG. 2A it can be seen that there is a fastener 96, in the form of a bolt, inserted through each of the aligned apertures (88A, 88B, 90C, 90D, 92A, 92B) of the insert 86, spacer 90, and beam 25B', respectively. The bolt's head or a nut at the opposing end thereof is sized to restrain pin 94 from sliding out of slot 71.

With reference to FIGS. 2J and 2K, it can be seen that each of the floor boards 404 comprises a laterally projecting edge 96 or a corresponding recess 98 for receipt of such age allowing the floor boards to be rested on each other.

Referring now to FIG. 2L the third plurality of reinforcement elements 58' is shown in more detail in its connection to the outer wall the elements 58' being mounted on an annular bracket 98 via a lower end 100 thereof.

The annular bracket 98 is formed with a bore 100 corresponding to an aperture 102 (seen in FIGS. 2M and 2N) via which the brackets 98 is secured to the outer wall 20B' via use of a bolt (not shown).

Drawing attention now to FIGS. 2A, and 2M to 2P, mounting of the second plurality of reinforcement elements 56' is shown.

The second plurality of reinforcement element 56' each have a planar shape (see FIG. 2P) and comprises a downwardly extending portion 104, a transversely extending portion 106 and a central portion 108 extending therebetween. Notably downwardly extending portion 104 is not seen in FIG. 2A since it is inserted into a groove (not seen) of the belly 24', thereby securing it thereto.

The transversely extending portion 106 comprises two oval-shaped apertures 110A, 110B (FIG. 2O).

As best seen in FIG. 2N side wall 18B' is formed with a vertical slot 112 and aperture 114. While not shown, outer side wall 20B' comprises a corresponding vertical slot and aperture.

As will be appreciated from FIGS. 2A and 2M the transverse portion 106 of element 56' is inserted through the vertical slot 112 of the inner and outer side walls (18B', 20B').

First and second securing pins (116, 118) are respectively slotted through slots (110A, 110B) to secure element 56' to the side walls (18B', 20B').

Both pins 116, 118 are formed with a bore 116A, 118A for receipt of a securing element therein.

Notably a portion 116B of pin 116, which is formed with the bore 116A, is significantly thicker than the opposing side thereof 116C.

Referring now to FIGS. 2Q and 2R, it can be seen that the peripheral reinforcement assembly 12' causes the vehicle to behave in the same manner as that described with reference to FIGS. 1D and 1E.

A notably difference is that the lower end 100 of the third reinforcement element 58' is at a height corresponding to the lower surface 44' of the floor 403' and consequently the side walls are substantially reinforced from this height (corresponding to the lower surface 44' of the floor 403') and above.

Consequently, the intersection of upper section 30' and intermediate 32' occurs at the height of the lower surface 44' of the floor 403' (as best seen in FIG. 2A).

It will be appreciated that a system in accordance with the subject matter of the present application can be configured differently for different types of vehicles.

For example, the system can be applied to a vehicle which has two adjacent side walls, but without any transverse sections. In such case the third plurality of reinforcement elements (58, 58') can be simply an elongated member free of the triangular portion 74.

Alternatively, the system can be applied to a vehicle which only has a single side wall on each side thereof. In such case the third plurality of reinforcement elements (58, 58') can be unnecessary.

It will be understood that the system can be free of the third plurality of reinforcement elements (58, 58'), whether the vehicle has single or double side walls, by simply configuring the first plurality of reinforcement elements to be of sufficient thickness to withstand the moment described with respect to FIG. 1. Or vice versa, the third plurality of reinforcement elements can be of sufficient thickness to render the first plurality unnecessary.

Figure 3:
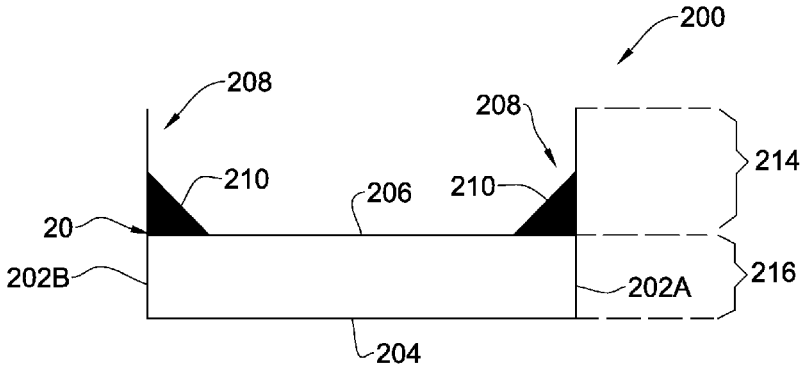
FIG. 3 is a schematic front view of a portion of a vehicle including yet another example of a system in accordance with the subject matter of the present application.

Referring to FIG. 3 there is illustrated a vehicle generally designated as 200 comprising side walls (202A, 202B), a belly 204 and floor 206 both of which extending between the side walls (202B, 202A), and a system 208 in accordance with another example of the subject matter of the present application.

The floor extends between and meets with each side wall along an intersection line 212 dividing the side wall into upper and lower side wall sections (214,216).

The system 208 in this example comprises only a plurality of reinforcement elements 210 of a single type.

Each of the reinforcement elements 210 connect the floor 206 to the side walls (202A, 202B), reinforce the side walls adjacent to the floor 206 and at a height thereabove to localize bending movement of the side walls at the lower side wall section during an explosive event.

In view of the explanations above, it will be understood that a second plurality of reinforcement elements (not shown) similar to those described above, connecting the belly 204 to the side walls (202A, 202B) can be added for directing the pending motion of the side walls during explosive impact to a specific section of the side walls.

It will thus be appreciated that there can be variations in the shape or types of elements used in its system in accordance with the subject matter of the present application.

Figure 4:
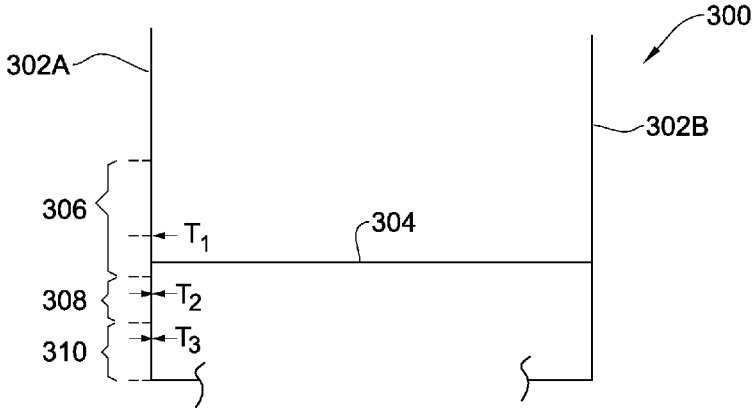
FIG. 4 is a schematic front view of a portion of a vehicle including still a further example of a system in accordance with the subject matter of the present application.

With reference to FIG. 4 a schematic example of a system in accordance with the subject matter of the present application is shown.

In FIG. 4 there is shown a vehicle 300 comprising side walls 302A, 302B, a floor 304 extending between the side walls (302A, 302B).

The side walls (302A, 302B) each comprising a first section extending from a height adjacent to or slightly below the height of the floor 304 to a height significantly thereabove, the first section being generally designated as 306.

Thus a second section of the side walls generally designated as 308 and being disposed lower than the first section 306, has a thickness T2, when viewed in a front sectional view the side walls (302A, 302B), which is smaller than a thickness T2 of the first section.

It will be appreciated that the greater thickness of the wall section adjacent the floor can be due to the addition of a reinforcement element, or a plurality of reinforcement elements, or the wall itself can be formed with a thickness greater than a thickness T2 of the section of the wall therebelow. In any of these cases, the desired bending motion of the side wall below the height of the floor 304 can be accomplished. As will be clear from the foregoing, there can be a further section of the wall 310 having a thickness T3 which is greater than the thickness T2 resulting in the bending motion being localized at a predetermined desired position of the side wall, which in this example is at the second section 308.

Figure 5A:
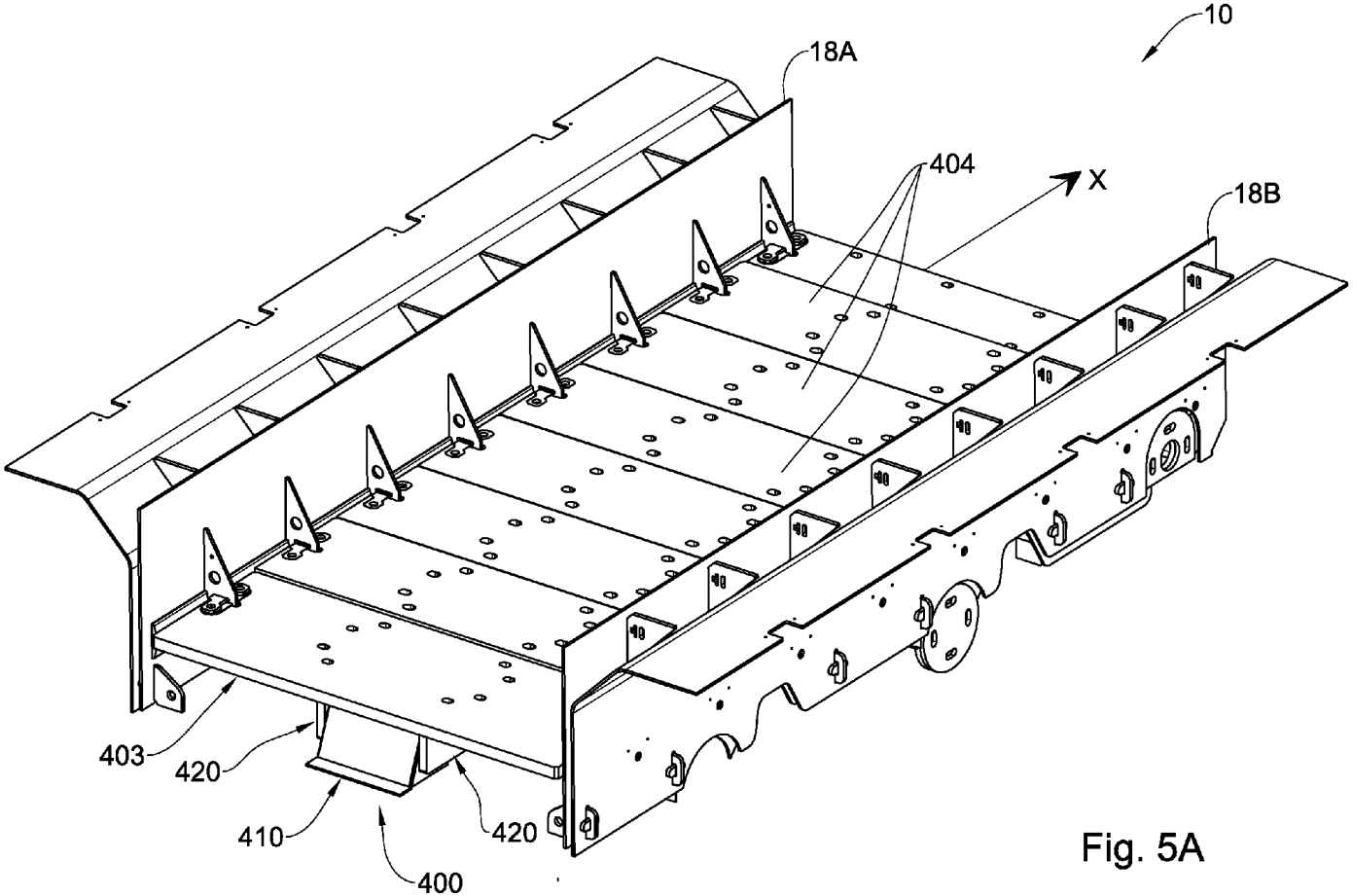
FIG. 5A is a schematic isometric view of a partial skeleton of a vehicle comprising a reinforced central reinforcement assembly according to the present invention.
Figure 5B:
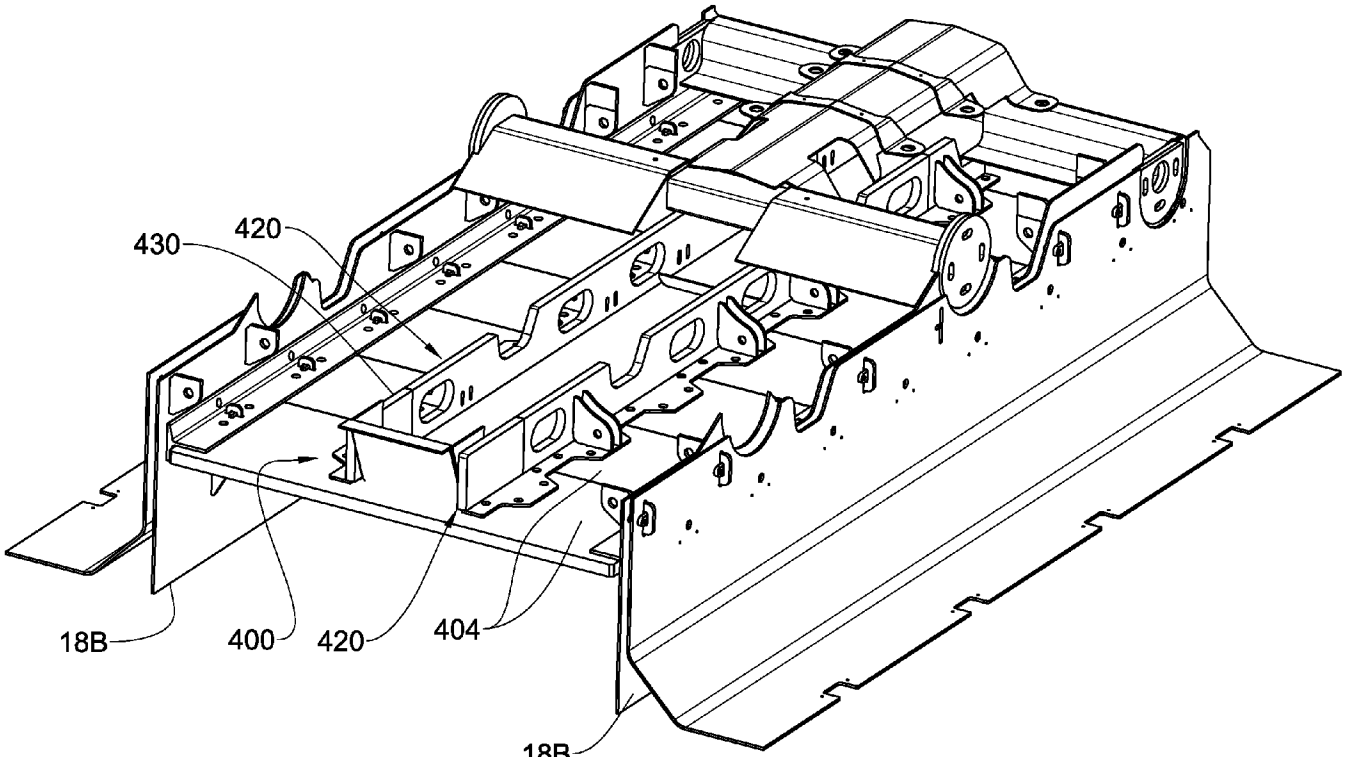
FIG. 5B is a schematic bottom isometric view of the vehicle shown in FIG. 5A.

With reference to FIGS. 5A and 5B, the body of a vehicle, generally designated as 10, is shown comprising two side walls 18A, 18B extending parallel to one another, with a plurality of floor boards 404 extending therebetween to form a floor. Underneath the floor boards 404, there extends a drive-train tunnel 410, along the longitudinal direction of the vehicle 10 denoted by X.

With particular reference to FIG. 5B, it is noted that only a portion of the drive-train tunnel 410 is shown, having side walls 412 extending along the longitudinal direction and having an orientation generally perpendicular to the floor boards 404. It is also observed that the drive-train tunnel 410 is partially encompassed by the central reinforcement assembly 400 comprising two longitudinal beams 420, a load distribution plate 430 and support ribs 440.

The arrangement is such that there are two longitudinal beams 420, each extending along a respective side wall 412 of the drive-train tunnel 410, and the load distribution plate is disposed between the drive-train tunnel 410 and the floor boards 404, also extending along the longitudinal direction of the vehicle 1. Thus, an inner zone can be defined as the space between the beams 420, and an outer zone can be defined as the space outside the beams 420.

The support ribs 440 are disposed in the outer zone at the angle formed between each beam 420 and the load distribution plate 430, so as to reinforce the formed corner. It is noted that the support ribs are With particular reference being drawn to FIGS. 6A to 6C, each longitudinal beam 420 has a body 422 formed, in cross-section, with a long side 421L and a short side 421S. Each beam 420 has an inner long side (facing the opposite beam) and an outer long side (facing away from the opposite beam). Each beam 420 is further formed with attachment openings 424 configured for attachment of the beams 420 to the tunnel 410, slots 426 for positioning of the support ribs 440 and recesses 428 for passing of the axles of the wheelbase therethrough (not shown).

Figure 7A:
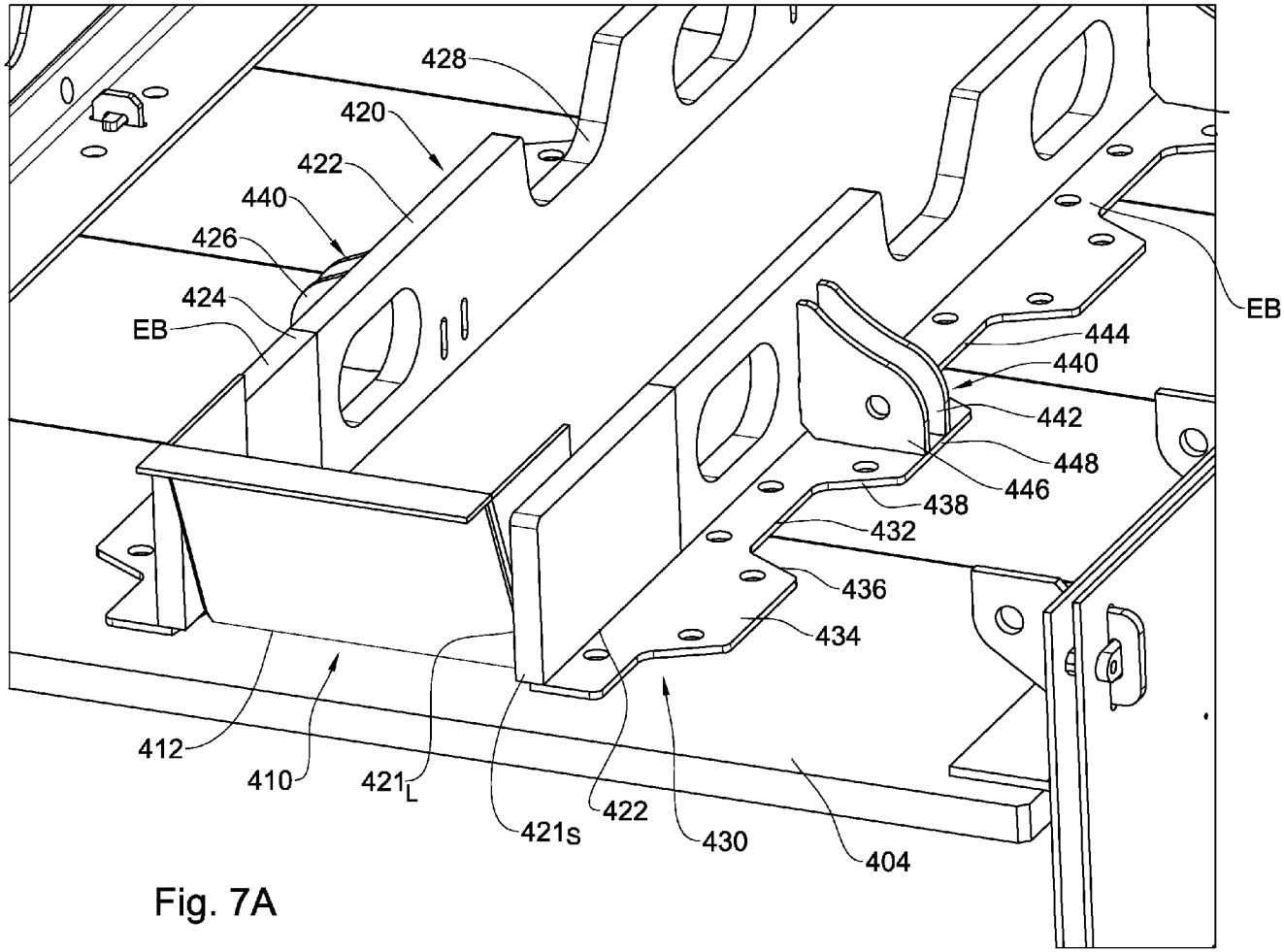
FIG. 7A is a schematic enlarged bottom-isometric view of the central reinforcement assembly shown in FIG. 5B.
Figure 7B:
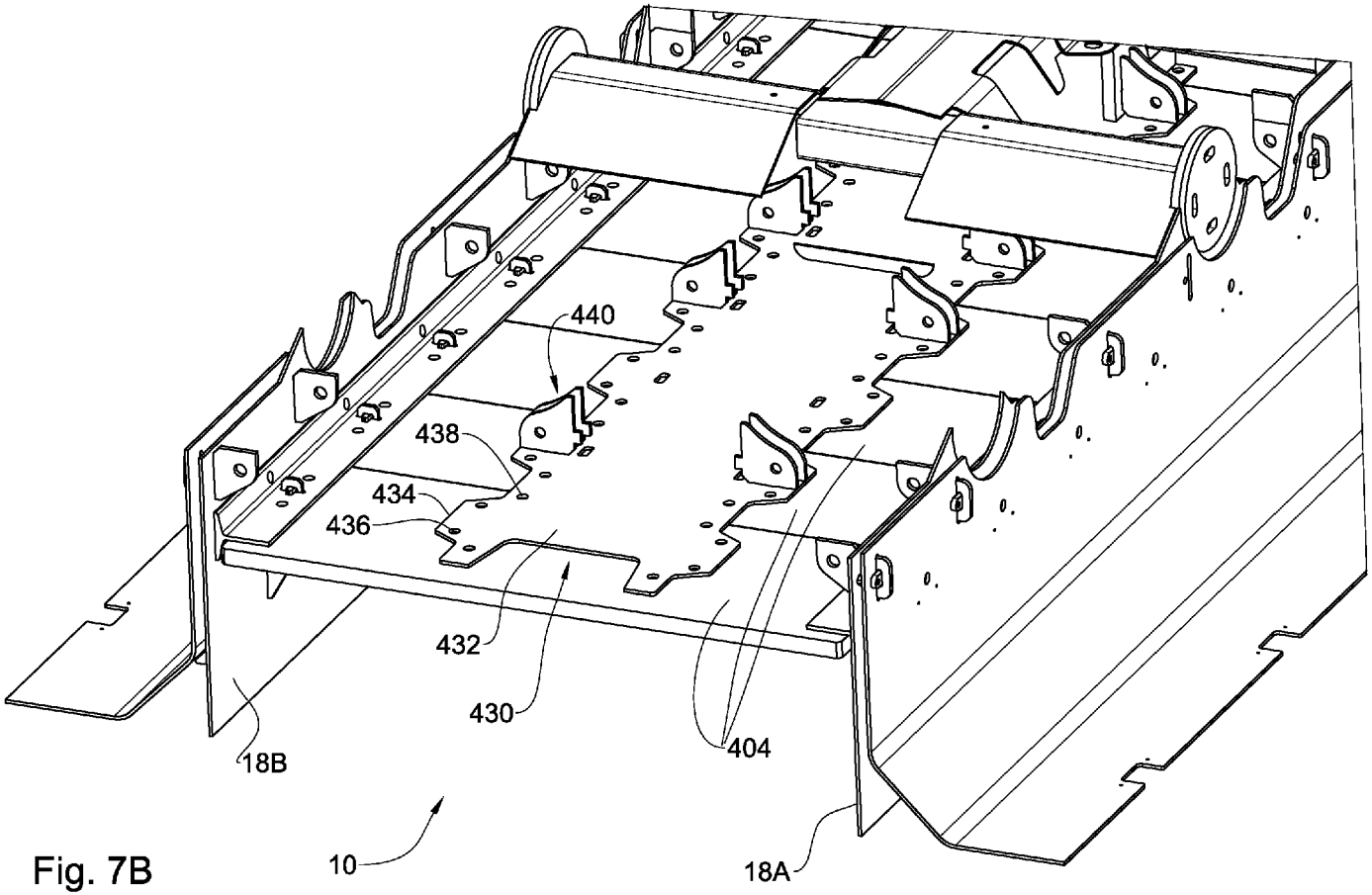
FIG. 7B is a schematic bottom-isometric view of the central reinforcement assembly shown in FIG. 7A, with several components thereof being removed.
Figure 7C:
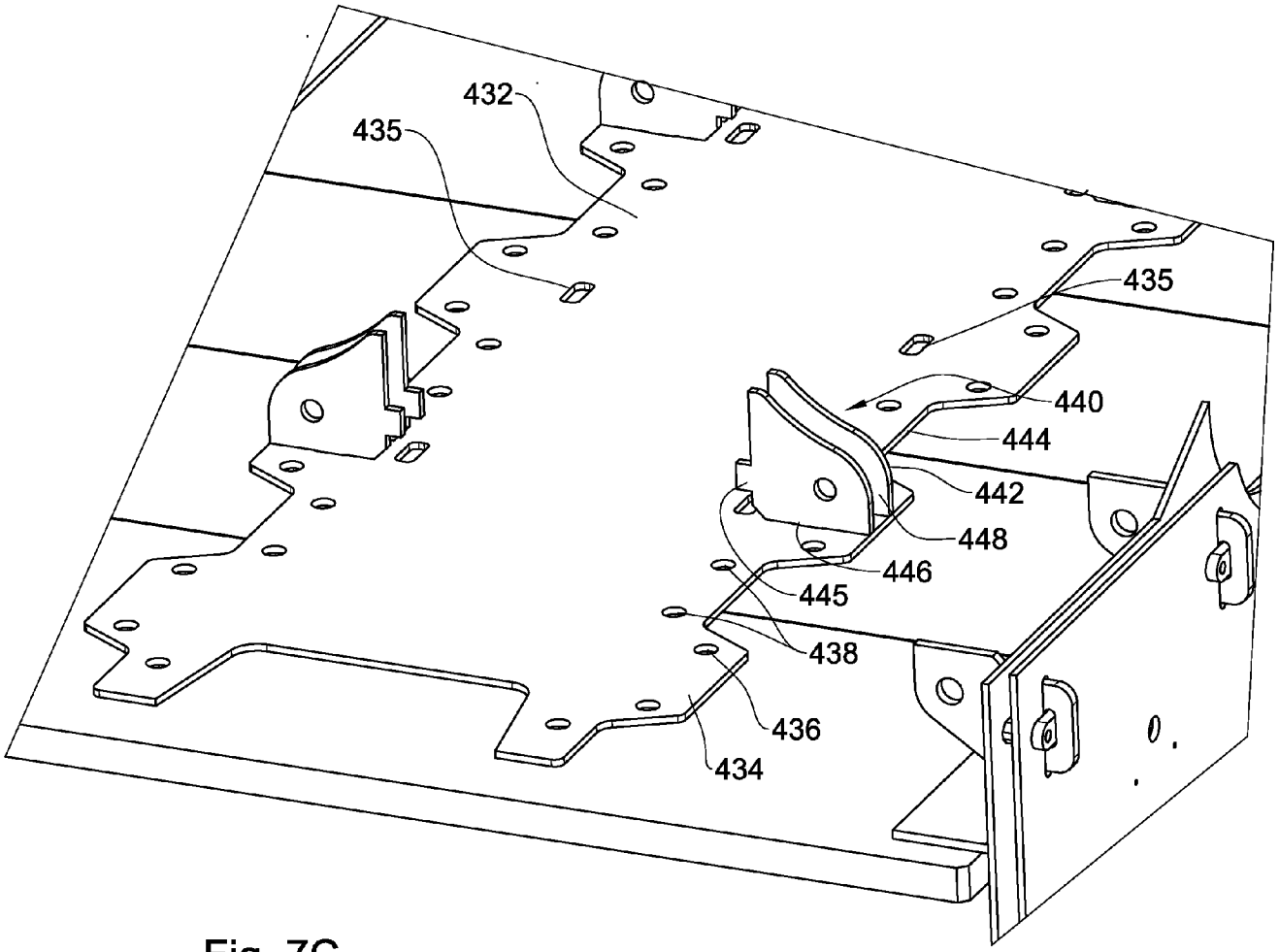
FIG. 7C is a schematic enlarged view of a portion of the central reinforcement assembly shown in FIG. 7B.
Figure 8A:
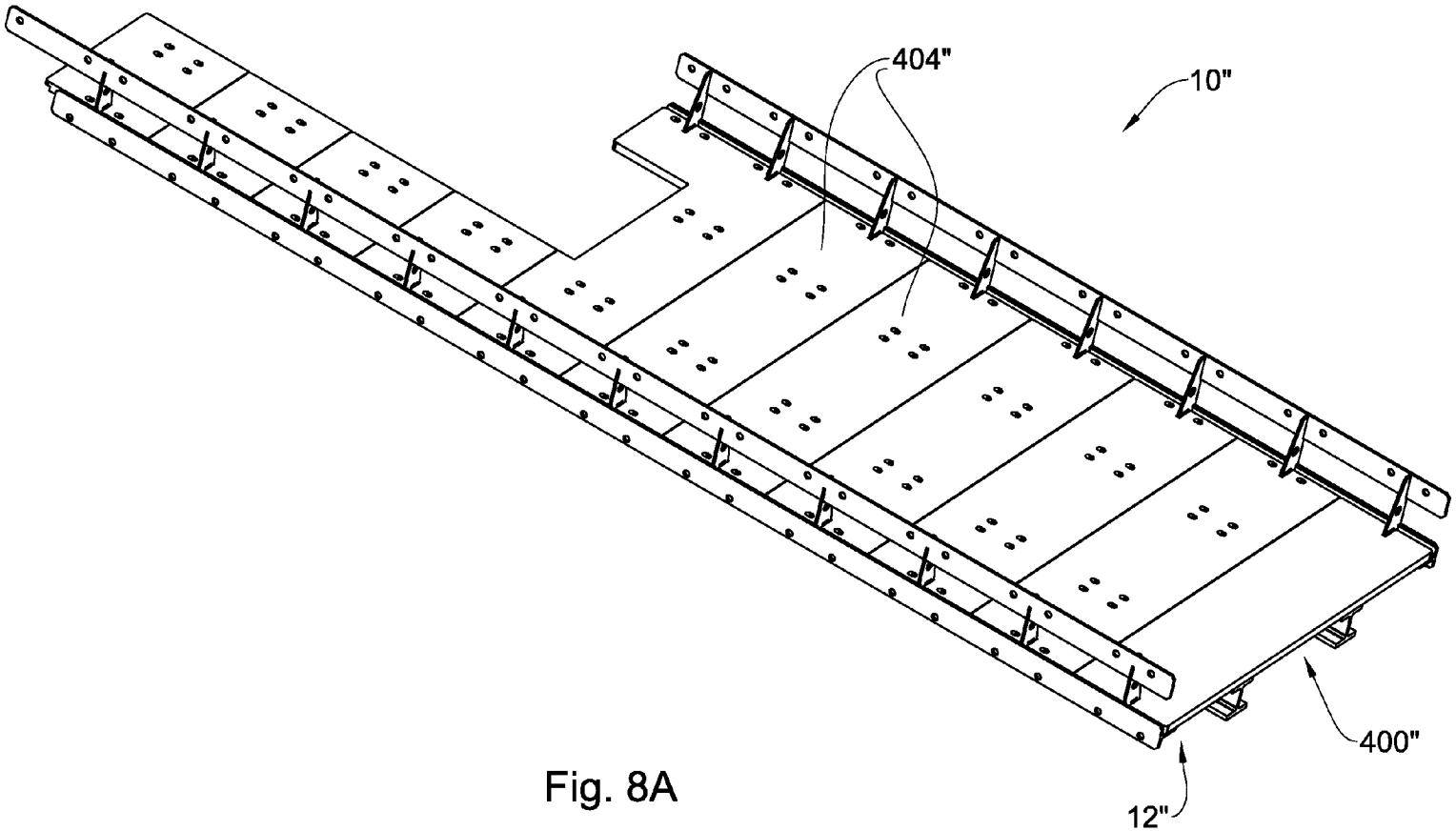
FIGS. 8A and 8B are schematic isometric and front views of a reinforcement system according to another example of the subject matter of the present application.
Figure 8B:
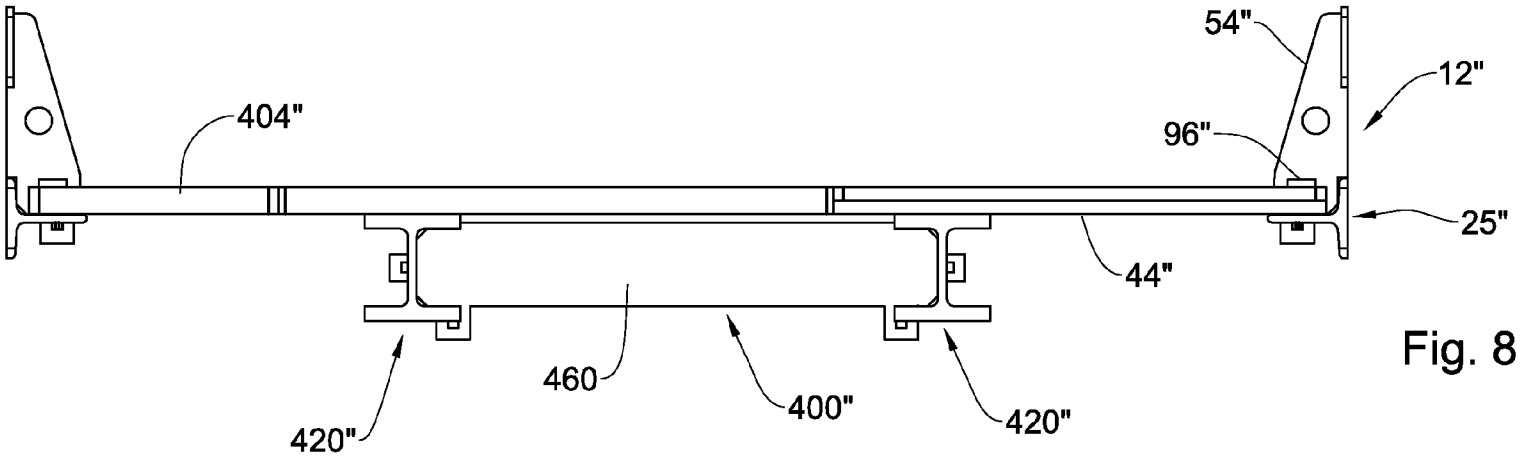
Figure 8D:
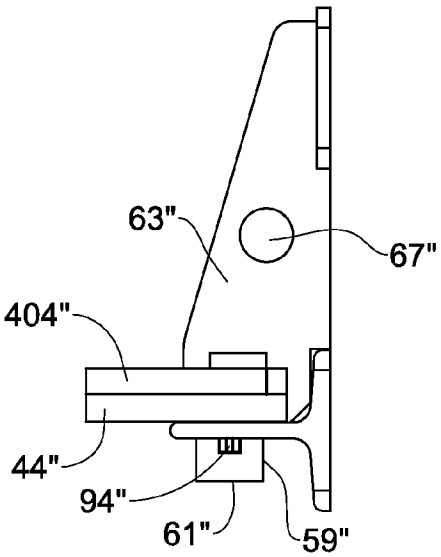
FIGS. 8C and 8D are schematic enlarged views of details shown in FIG. 8B.
Figure 8C:
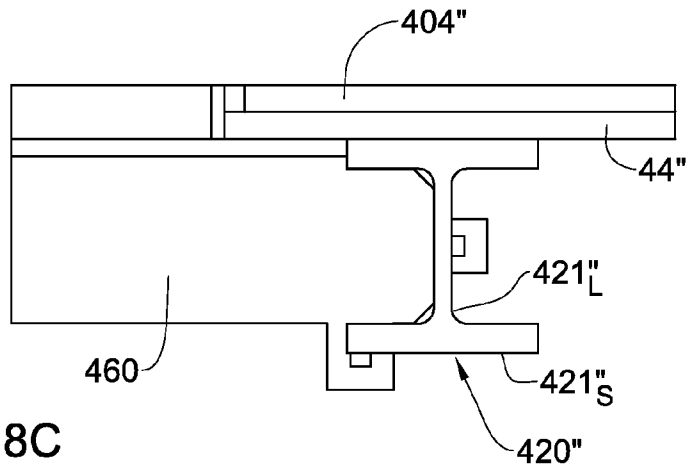
Figure 8E:
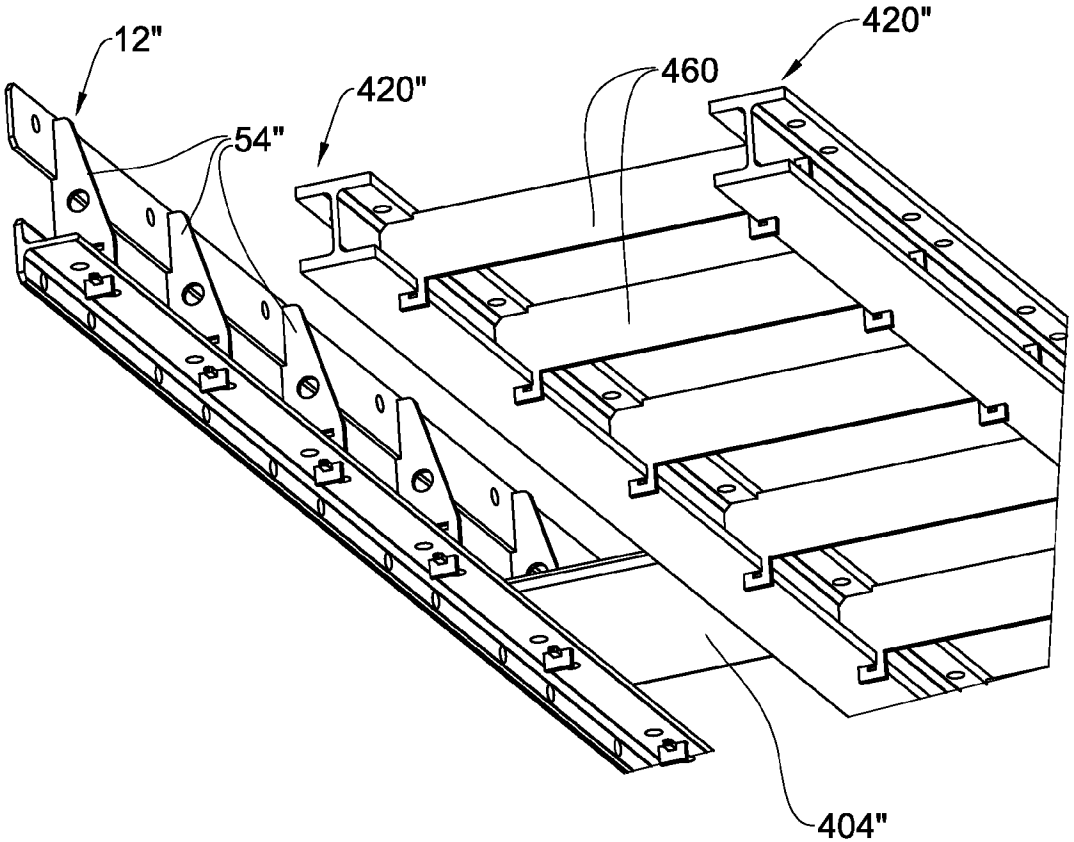
FIG. 8E is a schematic bottom isometric view of the reinforcement system shown in FIG. 8A.

With particular reference being drawn to FIG. 7A, the load distribution plate 440 comprises a central portion 432 having flaps 434 extending further therefrom in a direction perpendicular to the longitudinal direction of the vehicle (i.e. towards the side walls of the vehicle). The central portion 432 and flaps 434 are both formed with attachment holes configured for attachment of the plate 430 to the floor boards 404. With reference to FIG. 7C, the plate 430 is also formed with openings 435 configured for attachment of the plate 430 to the beams 420.

Figure 6A:
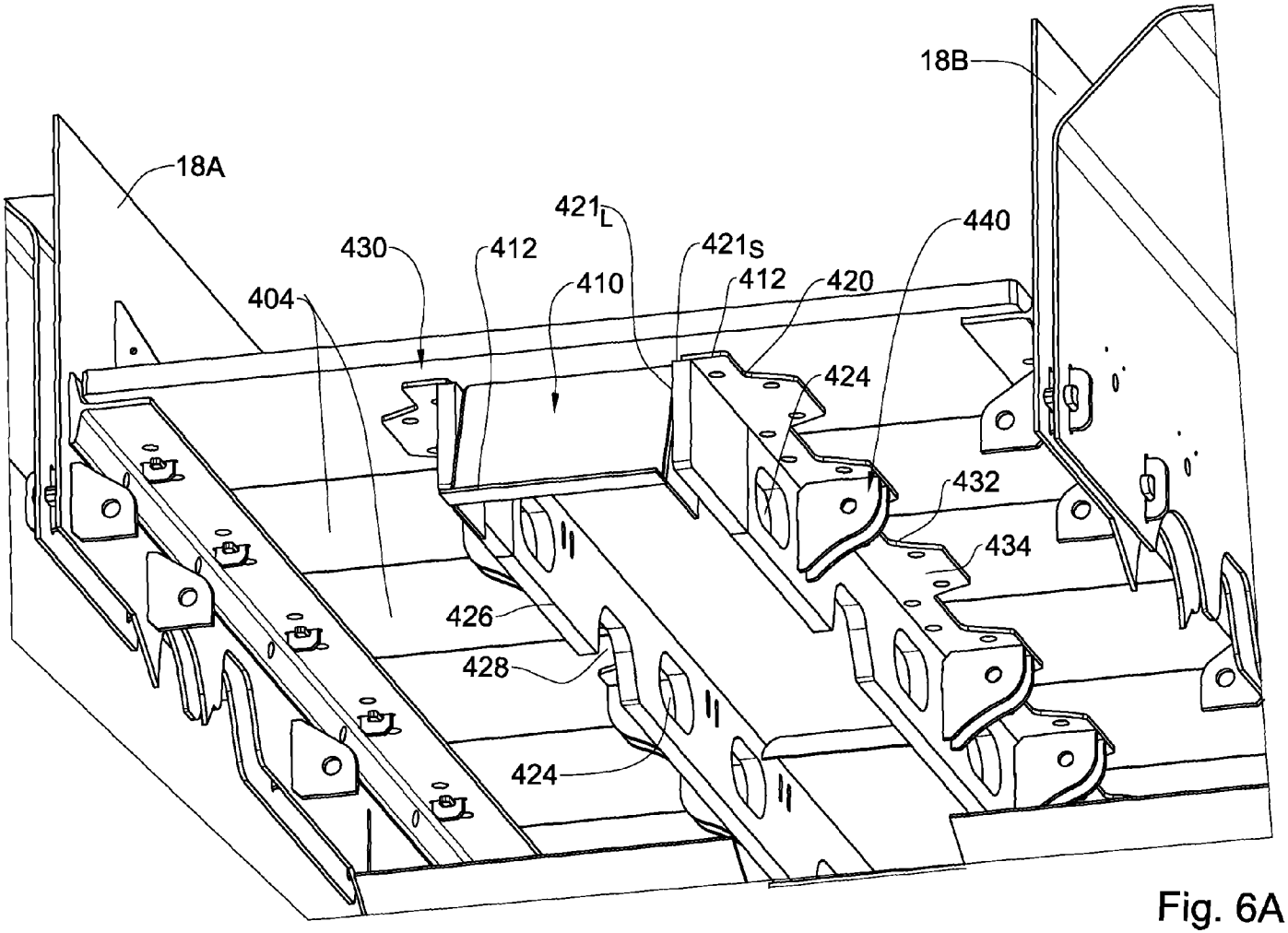
FIG. 6A is a schematic front isometric view of the central reinforcement assembly shown in FIG. 5B.
Figure 6B:
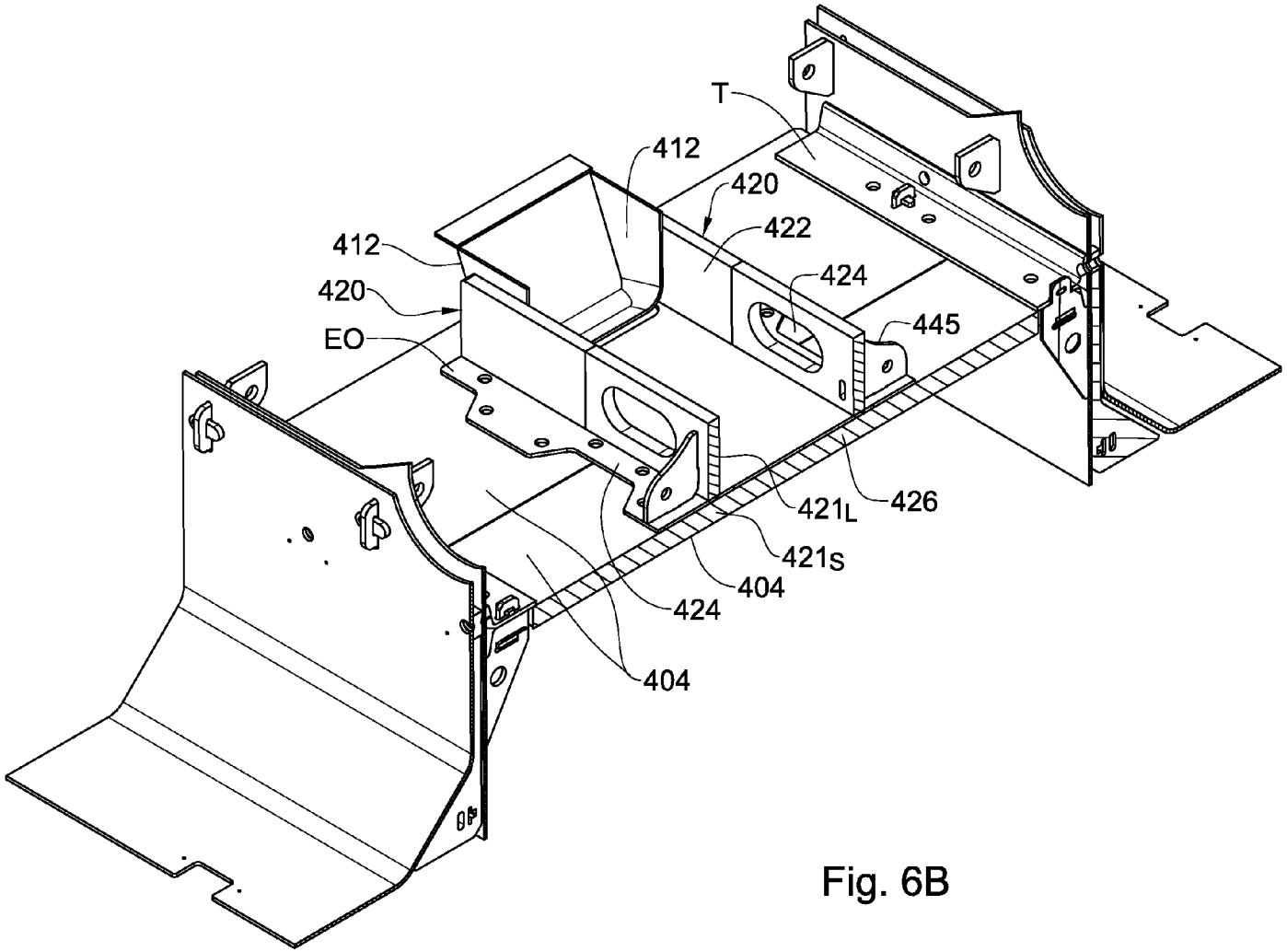
FIG. 6B is a schematic cross-sectional view of the central reinforcement assembly shown in FIG. 6A, taken along a plane perpendicular to a longitudinal direction of the vehicle.
Figure 6C:
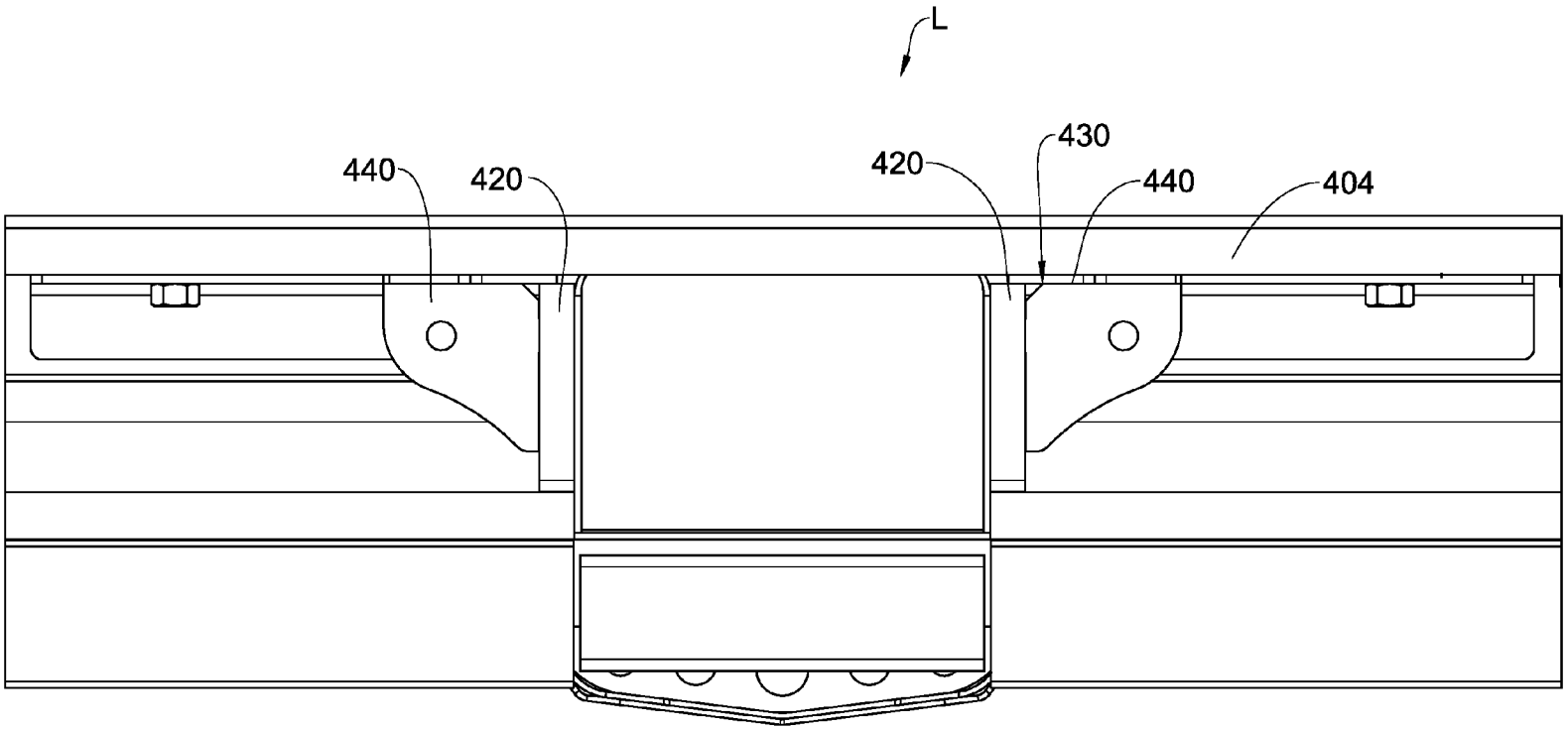
FIG. 6C is a schematic front view of the vehicle shown in FIG. 5A.

Reverting to FIG. 6B, in assembly, the central reinforcement assembly 400 is first constructed by positioning the beams 420 at the proper orientation with respect to the plate 430, and then positioning the support ribs 440 so that the protrusions 445 thereof are received in slots 426 of the beams 420, such that the edge 444 of the support rib is in contact with the beam 420 and the edge 446 thereof is in contact with the plate 430 (see FIG. 6B). Thereafter, welding is performed of the inner and outer edges EI, EO of the each beam to the plate 430. Additional welding is provided via openings 435 of the plate 430 to the beams 420. Additional welding is provided along the contact points between the ribs 440 and the beam 420 and plate 430.

Once the central reinforcement assembly is prepared, it is mounted onto the drive-train tunnel 410, and fixedly attached thereto. In particular, the beams 420 are welded to the side walls 412 of the drive-train tunnel 410 via openings 424, and additional welding is provided along a bottom edge EB of each beam to the drive-train tunnel 410.

Once the central reinforcement assembly 400 is fixedly attached to the drive-train tunnel 410, the floor boards 404 can assembled. The boards 404 are first mounted onto T-shaped beams T at the sides of the vehicle and onto the load distribution plate 430, and thereafter bolted to the load distribution plate 430 via openings 436 and 438 (which correspond to openings in the floor boards 404). It is observed that at the T-shape beams T, the floor boards are further reinforced using reinforcing elements.

Attention is now drawn to FIGS. 8A to 8E, in which yet another example of a reinforcement system according to the subject matter of the present application is shown, generally being designated as 10".

In the above referenced system 10", similar elements to those previously described have been designated similar reference numerals with the addition of a double-prime (").

The reinforcement system 10" shown is configured for operation with a structure in which there is no drive train, for example, the floor of a structure.

The reinforcement system 10" includes a central reinforcement assembly 400" and a peripheral reinforcement assembly 12".

Contrary to the previously described examples, the central reinforcement assembly 400" comprises two beams 420" which have an I cross-section. Nonetheless, it is appreciated that the width of the beam's cross-section is still shorter that the length thereof, and the beams 420" are attached to the floor boards 404" via their short-side.

It is also observed that the peripheral reinforcement assembly 12" has generally the same construction, with reinforcing elements 63", pins 94" etc., and operates much in the same way.

Those skilled in the art to which this invention pertains will readily appreciate that numerous changes, variations, and modification can be made without departing from the scope of the invention, mutatis mutandis.

The invention claimed is:

1. A reinforcement system for a vehicle, comprising:

side walls;

a floor extending therebetween and meeting with each side wall along an intersection line dividing the side wall into an upper and a lower side wall section, the floor having a length and a width;

a belly attached to the lower side wall section at a location thereof spaced from the intersection line;

a central reinforcement assembly that provides the length of the floor with a greater resistance to bending in a vertical direction than the width of the floor, thereby reducing deformation of the floor due to torque generated along the longitudinal direction of the vehicle; and a peripheral reinforcement assembly configured for reinforcing the upper and lower side wall sections, and including a localized weakened area at the lower side wall section, such that localized bending of the side wall takes place at the localized weakened area upon movement of the belly towards the floor.

2. The reinforcement system according to claim 1, wherein the peripheral reinforcement assembly is configured for providing a mechanical dissociation between the lower and upper side wall sections, for reducing loads mitigated to the floor and sidewalls of the vehicle by the belly.

3. The reinforcement system according to claim 1, wherein the central reinforcement assembly comprises at least a first and a second longitudinal beam oriented substantially parallel to each other, extending along the longitudinal direction of the vehicle when the central reinforcement assembly is mounted thereon, and having, in a cross-section taken substantially perpendicular to the longitudinal direction, at least one short side and at least one long side, such that the beams face each other with respective long sides thereof, the central reinforcement assembly further comprises a load distribution plate extending the longitudinal direction and oriented substantially perpendicular to the long sides of the longitudinal beams, one short side of each beam facing the plate and being attached thereto, the plate being configured for attachment to the floor.

4. The reinforcement system according to claim 3, wherein one long side of each beam is attached to an element of the vehicle associated with a drive-train thereof, at least when the vehicle is in use.

5. The reinforcement system according to claim 3, wherein the ratio between the lengths of the short side and long side respectively does not exceed 0.5:1.

6. The reinforcement system according to claim 3, wherein the load distribution plate has an extension, in a direction substantially perpendicular to the long side of the beams, which is greater in length than that of the short side of the beam, or an area substantially greater than that of the short sides of the beams.

7. The reinforcement system according to claim 3, wherein the area of the plate is at least 0.3 of the area of the floor that is free of any reinforcement elements.

8. The reinforcement system according to claim 3, wherein the vehicle comprises a drive-train tunnel that is disposed under the vehicle floor, and the load distribution plate is disposed between the drive-train tunnel and the vehicle floor.

9. The reinforcement system according to claim 8, wherein the load distribution plate is connected to the floor at a top side thereof, and to the short side of the longitudinal beams on a bottom side thereof.

10. The reinforcement system according to claim 3, wherein the central reinforcement assembly further comprises floor boards having an extension along the height axis of the vehicle that is substantially greater than that of the load distribution plate.

11. The reinforcement system according to claim 3, wherein the central reinforcement assembly further comprises support ribs, configured for being in contact both with the load distribution plate and the beams, so as to further reinforce the attachment between the latter and the former.

12. The reinforcement system according to claim 11, wherein the central reinforcement assembly is configured to be first fully assembled by the longitudinal beams being fixedly attached to the load distribution plate and the ribs, and only thereafter mounted as a single central reinforcement assembly onto the vehicle.

13. The reinforcement system according to claim 10, wherein the attachment of the load distribution plate to the floor boards is detachable, allowing the removal of any single desired floor board so as to provide access to automotive components disposed underneath the floor.

14. The reinforcement system according to claim 1, wherein the peripheral reinforcement assembly further comprises additional reinforcement elements disposed at a part of the side walls which is attached to the belly, at least a majority of each of the reinforcement elements extend along the upper side wall.

15. The reinforcement system according to claim 14, wherein the reinforcement elements and a part of the side wall adjacent thereto have a combined thickness T1, whilst at least a part of the lower side wall portion has a smaller thickness T2.

16. The reinforcement system according to claim 14, wherein the reinforcement elements are connected to the floor and an adjacent portion of the upper side wall.

17. The reinforcement system according to claim 14, wherein the reinforcement elements disposed at a part of the side walls which is attached to the belly, the additional reinforcement elements and a part of the side wall adjacent thereto have a combined thickness T3, whilst at least a part of the lower side wall portion disposed above the part of the side walls which is attached to the belly and below the intersection line has a smaller thickness T2.

18. A system for use in a reinforcement system of a vehicle, the system being configured for reinforcing the vehicle, the system comprising:

side walls;

a floor extending between the side walls and meeting with each side wall along an intersection line dividing the side wall into an upper and a lower side wall section, the floor having a length and a width;

a belly attached to the lower side wall section at a location thereof spaced from the intersection line; and reinforcement elements configured to localize, at the lower side wall sections, bending of the side wall caused by movement of the belly towards the floor, some of the reinforcement elements provide the length of the floor with a greater resistance to bending in a vertical direction than the width of the floor and some of the reinforcement elements reinforce the upper side wall section of the side wall and the lower side wall section of the side wall with an intermediate section between the upper and lower side wall sections having less reinforcement than either of the upper and lower side wall sections.

* * * * *